US008035611B2

(12) United States Patent
Sakamoto

(10) Patent No.: US 8,035,611 B2
(45) Date of Patent: Oct. 11, 2011

(54) ELECTROPHORETIC DISPLAY DEVICE AND DRIVING METHOD FOR SAME

(75) Inventor: Michiaki Sakamoto, Kawasaki (JP)

(73) Assignee: NEC LCD Technologies, Ltd, Kanagawa (JP)

( * ) Notice: Subject to any disclaimer, the term of this patent is extended or adjusted under 35 U.S.C. 154(b) by 904 days.

(21) Appl. No.: 11/611,022

(22) Filed: Dec. 14, 2006

(65) Prior Publication Data

US 2007/0139358 A1 Jun. 21, 2007

(30) Foreign Application Priority Data

Dec. 15, 2005 (JP) ..... 2005-362318
Dec. 28, 2005 (JP) ..... 2005-378274

(51) Int. Cl.
*G09G 3/34* (2006.01)

(52) U.S. Cl. ..... 345/107

(58) Field of Classification Search ..... 345/107
See application file for complete search history.

(56) References Cited

U.S. PATENT DOCUMENTS

| | | | | |
|---|---|---|---|---|
| 6,504,524 | B1 * | 1/2003 | Gates et al. | 345/107 |
| 6,531,997 | B1 * | 3/2003 | Gates et al. | 345/107 |
| 6,762,744 | B2 * | 7/2004 | Katase | 345/107 |
| 6,940,500 | B2 * | 9/2005 | Washio et al. | 345/204 |
| 2002/0033793 | A1 * | 3/2002 | Machida et al. | 345/107 |
| 2002/0196207 | A1 * | 12/2002 | Machida et al. | 345/55 |
| 2004/0222984 | A1 * | 11/2004 | Hamaguchi | 345/211 |
| 2005/0001812 | A1 * | 1/2005 | Amundson et al. | 345/107 |
| 2006/0132426 | A1 * | 6/2006 | Johnson | 345/107 |
| 2006/0139304 | A1 * | 6/2006 | Goden | 345/107 |
| 2006/0139305 | A1 * | 6/2006 | Zhou et al. | 345/107 |
| 2006/0238488 | A1 * | 10/2006 | Nihei et al. | 345/107 |
| 2007/0070029 | A1 * | 3/2007 | Johnson et al. | 345/107 |

FOREIGN PATENT DOCUMENTS

| | | | |
|---|---|---|---|
| JP | 2003005225 | A | 1/2003 |
| JP | 2004102054 | A | 4/2004 |
| JP | 2005150641 | A | 6/2005 |
| JP | 2005189851 | A | 7/2005 |
| JP | 2006189466 | A | 7/2006 |
| JP | 2007114622 | A | 5/2007 |
| WO | WO 03100757 | A1 * | 12/2003 |
| WO | 2005034077 | A1 | 4/2005 |
| WO | 2005050611 | A1 | 6/2005 |
| WO | 2005086131 | A1 | 9/2005 |
| WO | 2005088603 | A2 | 9/2005 |
| WO | 2005101362 | A1 | 10/2005 |

* cited by examiner

*Primary Examiner* — Richard Hjerpe
*Assistant Examiner* — Dorothy Harris
(74) *Attorney, Agent, or Firm* — Sughrue Mion, PLLC

(57) ABSTRACT

An electrophoretic display device is provided which is capable of preventing an afterimage and an image burn-in. Frames to make electrophoretic elements making up pictures of an active-matrix and a microcapsule-type electrophoretic display device be driven are divided into a plurality of white frames and black frames. The number of white frames to be used for writing on the electrophoretic elements by using a scanning driver and a data driver on one picture or between pictures is made to be equal to the number of black frames to be used for the writing and writing frames for particles having slow mobility responsive to variation in an electric field is provided last in the formation of the picture.

8 Claims, 19 Drawing Sheets

In the case of $V_{wg} = V_{gb}$ $V_{wg} = V_{gb} - \alpha$(corrected)

ELECTROPHORETIC DISPLAY DEVICE AND DRIVING METHOD FOR SAME

BACKGROUND OF THE INVENTION

1. Field of the Invention

The present invention relates to an electrophoretic display device and a method of driving the same and more particularly to the electrophoretic display device capable of providing excellent displaying by preventing an afterimage and/or image burn-in and to the method of driving the electrophoretic display device.

The present application claims priorities of Japanese Patent Application Nos. 2005-362318 filed on Dec. 15, 2005 and 2005-378274 filed on Dec. 28, 2005, which are hereby incorporated by reference.

2. Description of the Related Art

One example of electronic displays which enable reading of an electronic book, electronic newspaper, or a like with human eyes without causing stress on the eyes is an electronic paper display which is being developed earnestly. Requirements for the electronic paper display are to be thin, lightweight, resistant to breaking (cracking), easy to see at a printed level or, a like. As a display device that can satisfy these requirements, a reflective-type display is available which is so configured as not to use a backlight and to consume less power.

An example of the reflective-type display using no polarizer includes an electrophoretic display (hereafter called "EPD") or a like. There are several types of EPDs and an EPD using a microcapsule-type electrophoretic device (also referred simply as an "electrophoretic element") is described below.

FIG. 25 is an enlarged cross-sectional view conceptually showing configurations of an electrophoretic display panel and more particularly a cross-sectional view of monochrome microcapsule-type electrophoretic elements arranged in m-rows and n-columns in a matrix form. In the electrophoretic display panel, each of the microcapsule-type elements, as shown in FIG. 25, is formed in a layer-stacked structure in which a TFT (Thin Film Transistor) glass substrate 102, an electrophoretic film 110, PET (Polyethylene Terephthalate) facing substrate 120 are stacked in this order, all serving to enable active-matrix driving of the electrophoretic display device, and, for example, microcapsule-type electrophoretic elements 100-*m*1, 100-*m*2, and 100-*m*3 are formed in the m-rows.

On the TFT glass substrate 102 are formed TFT 104-*m*1, TFT 104-*m*2, and TFT 104-*m*3 each corresponding to each of the electrophoretic elements 100-*m*1, 100-*m*2, and 100-*m*3, pixel electrodes 106-*m*1, 106-*m*2, and 106-*m*3 each being connected to each of the TFT 104-*m*1, 104-*m*2, and 104-*m*3, and storage electrodes 108-*m*1, 108-*m*2, and 108-*m*3 each being formed in a manner to face each of the pixel electrodes 106-*m*1, 106-*m*2, and 106-*m*3. Thus, the microcapsule-type electrophoretic display device is constructed to display images by an active-matrix driving method. In a binder 112 made of polymer housed in the electrophoretic film 110, microcapsules being about 40 μm in size are spread all over within the binder 110. Conventionally, each of the microcapsules 114 is smaller by a specified value than a dimension of the pixel electrode of the microcapsule-type electrophoretic display device. Into each of the microcapsules 114 is injected a dispersant 116 in which a myriad of negatively-charged white pigment particles (white particles, for example, titanium oxide) 117 with the size at a nano-level and positively-charged black pigment particles (black particles, for example, carbon) 118 with the size also at the nano-level are suspended. In the PET facing substrate 120, one piece of a counter electrode 122 which faces the pixel electrodes 106-*m*1, 106-*m*2, and 106-*m*3 formed on the TFT glass substrate 102 is stuck to a plastic substrate 124. Therefore, each of the microcapsule-type electrophoretic elements 100-*m*1, 100-*m*2, and 100-*m*3 is made up of each of the TFT 104-*m*1, 104-*m*2, and 104-*m*3 corresponding to each of the pixel electrodes 106-*m*1, 106-*m*2, and 106-*m*3, the microcapsules 114, and a corresponding portion of the counter electrode 122.

FIG. 26 is a schematic circuit diagram of the microcapsule-type electrophoretic elements arranged in a matrix and in a plane form, which makes up the microcapsule-type electrophoretic display device (hereafter simply an "electrophoretic display device"). In FIG. 26, same reference numbers are assigned to components having the same function as in FIG. 25. In FIG. 26, a data line Dn typifies lines used to feed display data signals to each of the electro-phoretic elements 100-*mi* (i=1, 2, . . . , N) arranged in a horizontal direction, out of the electrophoretic elements 100-*mn* (m=1, 2, . . . , M, n=1, 2, . . . , N) arranged in a matrix form, which make up the electrophoretic display device. Moreover, a scanning line Gm typifies lines used to feed scanning voltages, during one scanning period, to the electrophoretic elements 100-*m*1, 100-*m*2, . . . , 100-*m*N arranged in a horizontal direction, out of the electrophoretic elements 100-*mn* arranged in a matrix form, which also make up the electrophoretic display device.

FIG. 27 is a schematic circuit diagram showing a driving circuit 140 of the conventional electrophoretic display device. The driving circuit 140 includes a scanning driver 142 to sequentially feed scanning voltages during one scanning period to each electrophoretic element group (100-*m*1, 100-*m*2, . . . , 100-*m*N) arranged in the horizontal direction, out of the electrophoretic elements arranged in the matrix form and a data driver 144 to sequentially feed display data signals through each data line Dn to each of the electrophoretic elements 100-*mi* arranged in the horizontal direction, out of the electrophoretic elements arranged in the matrix form. FIG. 28 is a schematic circuit diagram showing a data signal generating circuit 145 for every data line Dn, which makes up the data driver 144. The data signal generating circuit 145 includes a selecting signal generating circuit 146 to generate a selecting signal in response to picture data and a voltage selecting circuit 147 to output a voltage corresponding to a selecting signal output from the selecting signal generating circuit 146 to the data line Dn.

In the electrophoretic display device having configurations described above, a voltage is applied, in such a way as described below, to the pixel electrodes 106-*mn* making up the microcapsule-type electrophoretic elements 100-*mn* and an image corresponding to picture data input to the picture of the electrophoretic display device is displayed on its picture.

When the electrophoretic element 100-*mn* corresponding to a pixel on the picture of the electrophoretic display device is made to serve as a unit of displaying a white state (hereinafter simply "W"), a negative voltage is output to the pixel electrode 106-*mn* making up the electrophoretic elements 100-*mn*; that is, for example, a voltage of −15V is output from the data driver 144 to a data line, for example, to the data line Dn of the data driver 144 connected to the pixel electrode 106-*mn* during a period corresponding to required numbers of frames. This operation being described by referring to FIG. 28, the selecting signal generating circuit 146 receiving picture data outputs the negative voltage to a selecting line corresponding to the above pixel, for example, the selecting line 152-*n* during a period when the pixel is operating. This causes a pMOS (p-channel Metal Oxide Semiconductor) transistor, for example, the pMOS 154-*n* making up the voltage selecting circuit 147 to be turned ON and the voltage of −15V to be output to the data line Dn.

Also, when the electrophoretic element corresponding to a pixel on the picture of the electrophoretic display device is made to serve as a unit of displaying black (hereinafter simply "B"), a positive voltage is output to the pixel electrode 106-*mn* making up the electrophoretic element; that is, for example, a voltage of +15V is output from the data driver 144 to a data line, for example, to the data line Dn of the data driver 144 connected to the pixel electrode 106-*mn* during a period when required numbers of frames are displayed. This operation being described by referring to FIG. 28, the selecting signal generating circuit 146 receiving picture data outputs the negative voltage to the selecting line corresponding to the above pixel, for example, the selecting line 156-*n* during a period when the pixel is operating. This causes a pMOS (p-channel Metal Oxide Semiconductor) transistor, for example, the pMOS 158-*n* making up the voltage selecting circuit 147 to be turned ON and the voltage of +15V to be output to the data line Dn.

In the electrophoretic display device to display images in monochrome, owing to the memory characteristic that its electrophoretic element has, when display of a pixel is switched from W to B or from B to W, the application of such a voltage as described above to a pixel electrode of the electrophoretic element 100-*mn* corresponding to the pixel whose display is to be switched, however, when display of a pixel is switched from W to W, and from B to B, basically, the application of the voltage to the pixel is not required.

Next, driving of such an electrophoretic display device analyzed by the inventor of the present invention is described below. As described above, in the electrophoretic film 110, when display of a pixel is changed from W to B, it is necessary to apply a positive voltage to a pixel electrode and when display of a pixel is changed from B to W, it is necessary to apply a negative voltage to the pixel electrode, and when display of a pixel is changed from W to W, and from B to B, it is necessary to apply a voltage of 0V.

Moreover, in the case of an active-matrix type display device such as a liquid crystal display device, a picture can be rewritten during a period corresponding to one frame being 1/60 Hz (=16.6 ms). However, in the case of the electrophoretic display device, it is impossible to rewrite a picture during a period corresponding to one frame being 1/60 Hz (=16.6 ms). The reason for this is that, for example, in the microcapsule-type electrophoretic element making up the electrophoretic display device, the particles 117, 118 are sealed in the microcapsules 114 filled with a dispersant and the particles 117, 118 therein have a slow response and, as a result, rewriting of a picture cannot be completed unless a voltage continues to be applied during a period while a plurality of frames is displayed. Therefore, in the electrophoretic display device, generally, as shown in FIG. 29, a PWM (Pulse Width Modulation) driving method is employed in which, when display of a pixel is changed from B to W, a specified negative voltage continues to be applied during a period corresponding to a plurality of frames and, when display of a pixel is changed from W to B, a specified positive voltage continues to be applied during a period corresponding to the plurality of frames.

In the conventional electrophoretic display device, in order to achieve the driving method as shown in FIG. 29, it is supposed that, a difference is calculated between a voltage applied to a current picture stored in a frame buffer made up of SRAMs (Static Random Access Memories) and a voltage applied to its next picture and, when display of a pixel is changed from B to W and from W to B, a corresponding voltage is applied, based on the calculated difference in the voltages, during a period corresponding to a plurality of frames. To apply these voltages, a ternary (+V, 0V, and −V) driver is used as a H-driver and Vcom is set to be 0V. Changing of display on a picture from B to W and from W to B is made at time when the corresponding frames are displayed.

However, further analysis by the inventor has demonstrated that the conventional electrophoretic display device described above has technological problems. That is, when the conventional microcapsule-type electrophoretic element is driven in the driving way described in FIG. 30, a decrease of white luminance or an increase of black luminance was found when the microcapsule-type electrophoretic element with a voltage being not applied to its pixel electrode is driven, not only due to a memory characteristic of its microcapsule-type electrophoretic element but also due to influences by a gate line and/or data line of the microcapsule-type element or to DC (Direct Current) component contained in common potentials of a counter electrode. As a result, when display is switched from W to W and from B to W, a difference in white luminance occurs (see FIG. 31 and FIG. 32) and the first afterimage problem arises that, while the next picture is being displayed, a current picture remains persistent. Also, the same problem arises when display of a picture is changed from B to B and from W to B.

Also, when a high-definition electronic book display terminal device is fabricated, when a dither pattern is displayed in two gray levels, or when images are made to be colored, it is necessary to set a pixel pitch to be 150 μm or less. However, it was found that, if a pixel pitch was made narrower, a microcapsule-type electrophoretic element was affected by a pixel voltage applied to a neighboring microcapsule electrophoretic element. More specifically, it was also found that, in order to display a dither pattern in two gray levels, when a pattern in a current image is displayed in black and a pattern in a next image is displayed in a checkered manner, a black display region on a picture is damage, that is, a display region originally prepared for pixels is reduced. When a black character of some regional type is displayed on the current picture and a dither pattern is displayed on the next picture, the second afterimage problem occurs that the character displayed on the current picture remains persistent on the next picture.

The above problem was found to occur due to the reason that, according to the conventional driving method, since no pixel voltage is applied to the pixel for a character of "NTL" displayed in black on the current picture shown in FIG. 33 and to the pixel for the dither pattern displayed in black on the next picture, in the case where a pixel electrode is a fine and small pattern having the size of 100 μm to 150 μm, the pixel with no voltage applied picks up a voltage applied to a neighboring pixel for white display and, as a result, white particles appear toward a surface of the microcapsule placed on the pixel electrode of the neighboring pixel (see FIG. 34).

As described above, when display on a picture is changed sequentially, for example, from B to W, from W to B, and from B to W and positive or negative voltages of +15V, −15V, +15, and −15V are applied alternately to pixel electrodes of pixels and, therefore, no DC current is applied to the electrophoretic element. However, if display on the picture is changed continuously from B to B, then from B to B, and further from B to B, and a voltage of +15V is applied to pixel electrodes during a period corresponding to many frames, or if display on the picture is changed from W to W, then from W to W, and further from W to W and a voltage of −15V continues to be applied to pixel electrodes during a period corresponding to many frames and, as a result, a positive or negative DC potential continues to be constantly applied to the electrophoretic elements to which the above +15V or −15V is applied. Therefore, it was found that a charged-up damage occurs in the electrophoretic film and, even if display of images are terminated by applying 0V, inverted image that displayed only the charged-up portion is still displayed, causing an image burn-in.

SUMMARY OF THE INVENTION

In view of the above, it is an object of the present invention to provide an electrophoretic display device capable of preventing occurrence of an afterimage and an image burn-in.

According to a first aspect of the present invention, there is provided an electrophoretic display device including:

an electrophoretic display panel which includes:

a first substrate on which there are arranged a plurality of signal lines extending in parallel to one another along a first direction, a plurality of scanning lines extending in parallel to one another along a second direction orthogonal to the first direction, and a plurality of pixel electrodes as electrophoretic elements in such a manner to correspond to each intersection of one of the signal lines and one of the scanning lines in a one-to-one relationship, a second substrate having a transparent counter electrode to face the plurality of pixel electrodes, and first colored charged particles with a first color and a first polarity and second colored charged particles with a second color and a second polarity which are sandwiched in a manner to be movable between each of the plurality of pixel electrodes and the transparent counter electrode, whereby pixels are arranged in a matrix form; and a potential difference applying unit to apply, when each of a plurality of pictures including a first pattern having the first color and a second pattern having the second color is displayed on a display area of the electrophoretic display panel, a potential difference corresponding to each of the first color and the second color between at least one of the pixel electrodes corresponding to each of the first pattern and the second pattern and the transparent counter electrode during a period corresponding to a specified number of frames, wherein the potential difference applying unit includes:

a first unit to provide a first frame group made up of a specified number of first frames and corresponding to the first color and a second frame group made up of a specified number of second frames and corresponding to the second color in specified order and for every the picture; and a second unit to apply, in displaying the picture, a potential difference corresponding to the first color for the first frame group between each of the pixel electrodes corresponding to the first pattern and the transparent counter electrode, when the first frame group is generated by the first unit, and a potential difference corresponding to the second color for the second frame group between each of the pixel electrodes corresponding to the second pattern and the transparent counter electrode, when the second frame group is generated by the first unit.

In the foregoing, a preferable mode is one wherein the second unit further includes a third unit to apply, when any one color of the first and second colors to be displayed in a given picture is to be displayed continuously in a subsequent picture, the potential difference corresponding to another color of the first and second colors, between each of the corresponding pixel electrodes and the counter electrode, in a transition state between any one frame group of the first frame group and the second frame group, provided for obtaining the given picture, and the any one frame group provided for obtaining the subsequent picture, the potential difference corresponding to the other color which is opposite in polarity to the potential difference corresponding to the any one color, and applied during a period corresponding to another frame group of the first frame group and the second frame group.

Also, a preferable mode is one wherein the second unit includes a fourth unit to make a number of frames required to make at least one of the pixel electrodes as electrophoretic elements display any one color of the first and second colors on a given picture be approximately equal to a number of frames required to make the one pixel electrode that had displayed the any one color in the given picture display another color on the subsequent picture.

Also, a preferable mode is one wherein the fourth unit drives to make a following equation hold among a number of frames T1 required to make the one pixel electrode display the any one color on a first picture, a number of frames T2 required to make the one pixel electrode that had displayed the any one color in the first picture display the other color on a second picture subsequent to the first picture, a number of frames T3 required to make the one pixel electrode that had displayed the other color in the second picture display the other color on a third picture subsequent to the second picture, and a number of frames T4 required to make the one pixel electrode that had displayed the other color in the third picture display the any one color on a fourth picture subsequent to the third picture:

$$T2+T3=T1+T4$$

Also, a preferable mode is one wherein the second unit further includes a fifth unit to set a frame group, of the first frame group and the second frame group, which moves charged particles having slow mobility responsive to variation in an electric field toward the counter electrode to a last frame group in formation of the picture.

Also, a preferable mode is one wherein the second unit includes a sixth unit to apply, when a potential difference changes between at least one of the pixel electrodes and the counter electrode at time of switching of the picture, an intermediate potential difference in a transition state between the potential difference applied before the switching of the picture and the potential difference to be applied after the switching.

Also, a preferable mode is one wherein the sixth unit is configured so that a following equation hold between a number of frames T1 by which an intermediate potential difference V1 is applied which is the intermediate potential difference to be applied between at least one of the pixel electrodes and the counter electrode when the one of the pixel electrodes switches display from any one color of the first and second colors to another color and a number of frames T2 by which an intermediate potential difference V2 is applied which is the intermediate potential difference to be applied between the one of the pixel electrodes and the counter electrode when the one of the pixel electrodes switches display from the other color to the any one color:

$$V1\times T1=V2\times T2$$

Also, a preferable mode is one wherein, in the electrophoretic display panel, each of the pixel electrodes on the first substrate is connected through each of gate elements controlled by a signal fed from each of the scanning lines to each of the signal lines, the second substrate has one piece of the transparent counter electrode that faces an entire region of the first substrate and the first colored charged particles and the second colored charged particles are suspended in a dispersant sealed in each of capsules which are dispersed in a binder between the first substrate and the second substrate.

Also, a preferable mode is one wherein the first color includes any one of black and white, and the second color includes another one of black and white.

Also, a preferable mode is one wherein the second unit used to apply the potential difference is a ternary driver to fix a potential of the counter electrode to a reference potential and to change an electric potential of the pixel electrodes by an amount of the potential difference from the reference voltage.

Also, a preferable mode is one the second unit used to apply the potential difference is a binary driver to change an electric potential of the counter electrode by an amount of the potential difference from the reference potential depending on the first color or the second color and to change an electric potential of the pixel electrodes so as to generate the potential difference corresponding to the first color or the second color between the counter electrode and the pixel electrodes according to the change in a potential of the counter electrode.

According to a second aspect of the present invention, there is provided a method of driving an electrophoretic display device: an electrophoretic display panel which includes: a first substrate on which there are arranged a plurality of signal lines extending in parallel to one another along a first direction, a plurality of scanning lines extending in parallel to one another along a second direction orthogonal to the first direction, and a plurality of pixel electrodes as electrophoretic elements in such a manner to correspond to each intersection of one of the signal lines and one of the scanning lines in a one-to-one relationship, a second substrate having a transparent counter electrode to face the plurality of pixel electrodes, and first colored charged particles with a first color and a first polarity and second colored charged particles with a second color and a second polarity which are sandwiched in a manner to be movable between each of the plurality of pixel electrodes and the transparent counter electrode, whereby pixels are arranged in a matrix form, wherein, when each of a plurality of pictures including a first pattern having the first color and a second pattern having the second color is displayed on a display area of the electrophoretic display panel, a potential difference corresponding to each of the first color and the second color is applied between at least one of the pixel electrodes corresponding to each of the first pattern and the second pattern and the transparent counter electrode during a period corresponding to a specified number of frames, the method including:

a step of providing a first frame group made up of a specified number of first frames and corresponding to the first color and a second frame group made up of a specified number of second frames and corresponding to the second color in specified order and for every the picture; and a step of applying, in displaying the picture, a potential difference corresponding to the first color for the first frame group between each of the pixel electrodes corresponding to the first pattern and the transparent counter electrode, when the first frame group is generated by the first unit, and a potential difference corresponding to the second color for the second frame group between each of the pixel electrodes corresponding to the second pattern and the transparent counter electrode, when the second frame group is generated by the first unit.

According to a third aspect of the present invention, there is provided an electrophoretic display device including:

an electrophoretic display panel which includes:

a first substrate on which there are arranged a plurality of signal lines extending in parallel to one another along a first direction, a plurality of scanning lines extending in parallel to one another along a second direction orthogonal to the first direction, and a plurality of pixel electrodes as electrophoretic elements in such a manner to correspond to each intersection of one of the signal lines and one of the scanning lines in a one-to-one relationship, a second substrate having a transparent counter electrode to face the plurality of pixel electrodes, and first colored charged particles with a first color and a first polarity and second colored charged particles with a second color and a second polarity which are sandwiched in a manner to be movable between each of the plurality of pixel electrodes and the transparent counter electrode, whereby pixels are arranged in a matrix form; and a potential difference applying unit to apply, when each of a plurality of pictures including a first pattern having the first color, a second pattern having the second color and at least one half-tone pattern having a half tone color between the first color and the second color is displayed on a display area of the electrophoretic display panel, a potential difference corresponding to each of the first color, the second color and the one half-tone pattern between at least one of the pixel electrodes corresponding to each of the first pattern and the second pattern and the transparent counter electrode during a period corresponding to a specified number of frames, wherein the potential difference applying unit includes:

a first unit to generate a plurality of frame groups each made up of specified number of specified frames, for every the picture, to output the potential difference for each of the first color, the second color and the half tone color to be displayed on the display area in specified order and a second unit to apply, in any one of the plurality of the frame groups to be sequentially generated by the first unit in displaying the picture, a potential difference of each of the frame groups between the counter electrode and each of the pixel electrodes corresponding to the first pattern, the second pattern or the one half-tone pattern.

In the foregoing, a preferable mode is one wherein the second unit further includes a third unit to apply, when any one color of the first color, the second color and the one half tone color to be displayed in a given picture is to be displayed continuously in a subsequent picture, the potential difference corresponding to another color, different from the any one color, between each of the corresponding pixel electrodes and the counter electrode, in a transition state between any one frame group corresponding to the any one color, provided for obtaining the given picture, and the any one frame group provided for obtaining the subsequent picture, the potential difference corresponding to the other color which is opposite in polarity to the potential difference corresponding to the any one color, and applied during a period corresponding to another frame group different from the any one frame group.

Also, a preferable mode is one wherein the second unit further includes a fourth unit to make a number of frames required to apply a specified potential difference to at least one of the pixel electrodes as electrophoretic elements on a given picture be approximately equal to a number of frames required to apply on the subsequent picture an opposite potential difference having an opposite polarity to the specified potential difference to the one of the pixel electrodes to which the specified potential difference had been applied.

Also, a preferable mode is one wherein the fourth unit drives to make a following equation hold among a number of frames T1 required to apply the specified potential difference to at least one of the pixel electrodes on a first picture, a number of frames T2 required to apply the opposite potential difference having an opposite polarity to the specified potential difference to at least one of the pixel electrodes to which the specified potential difference had been applied on a second picture subsequent to the first picture, a number of frames T3 required to apply subsequently the opposite potential difference to the one of the pixel electrodes to which the opposite potential had been applied on a third picture subsequent to the second picture, and a number of frames T4 required to apply the specified potential difference to the one of the pixel electrodes to which the opposite potential difference on a fourth picture subsequent to the third picture:

$$T2+T3=T1+T4$$

Also, a preferable mode is one wherein the second unit further includes a fifth unit to set a frame group, among the plurality of the frame groups, which moves charged particles having slow mobility responsive to variation in an electric field toward the counter electrode to a last frame group in formation of the picture.

Also, a preferable mode is one wherein the second unit includes a sixth unit to apply, when a potential difference changes between at least one of the pixel electrodes and the counter electrode at time of switching of the picture, an intermediate potential difference in a transition state between the potential difference applied before the switching of the picture and the potential difference to be applied after the switching.

Also, a preferable mode is one wherein the sixth unit is configured so that a following equation hold between a number of frames T1 by which an intermediate potential difference V1 is applied which is the intermediate potential difference to be applied between at least one of the pixel electrodes and the counter electrode when the one of the pixel electrodes switches display from any one color of the first color, the second color and the one half tone color to another color, different from the any one color, and a number of frames T2 by which an intermediate potential difference V2 is applied which is the intermediate potential difference to be applied between the one of the pixel electrodes and the counter electrode when the one of the pixel electrodes switches display from the other color to the any one color:

$$V1\times T1=V2\times T2$$

Also, a preferable mode is one wherein, in the electrophoretic display panel, each of the pixel electrodes on the first substrate is connected through each of gate elements controlled by a signal from each of the scanning lines to each of the signal lines, the second substrate has one piece of transparent counter electrode that faces an entire region of the first substrate and the first colored charged particles and the second colored particles are suspended in a dispersant sealed in each of capsules which are dispersed in a binder between the first substrate and the second substrate.

Also, a preferable mode is one wherein the first color includes any one of black and white, the second color includes another one of black and white, and the one half tone color includes gray.

Also, a preferable mode is one wherein the first color includes any one of black and white, the second color includes another one of black and white, and the half tone colors include light gray and dark gray.

Also, a preferable mode is one wherein switching of display between the light gray and dark gray is performed in such a manner where display of white is inserted between display of the light gray and display of the dark gray.

According to a four aspect of the present invention, there is provided a method of driving an electrophoretic display device including: an electrophoretic display panel which includes: a first substrate on which there are arranged a plurality of signal lines extending in parallel to one another along a first direction, a plurality of scanning lines extending in parallel to one another along a second direction orthogonal to the first direction, and a plurality of pixel electrodes as electrophoretic elements in such a manner to correspond to each intersection of one of the signal lines and one of the scanning lines in a one-to-one relationship, a second substrate having a transparent counter electrode to face the plurality of pixel electrodes, and first colored charged particles with a first color and a first polarity and second colored charged particles with a second color and a second polarity which are sandwiched in a manner to be movable between each of the plurality of pixel electrodes and the transparent counter electrode, whereby pixels are arranged in a matrix form; wherein, when each of a plurality of picture s including a first pattern having the first color, a second pattern having the second color and at least one half-tone pattern having a half tone color between the first color and the second color is displayed on a display area of the electrophoretic display panel, a potential difference corresponding to each of the first color, the second color and the one half-tone pattern between at least one of the pixel electrodes corresponding to each of the first pattern and the second pattern and the transparent counter electrode during a period corresponding to a specified number of frames, the method including:

a step of generating a plurality of frame groups each made up of specified number of specified frames, for every the picture, to output the potential difference for each of the first color, the second color and the half tone color to be displayed on the display area in specified order and a step of applying, in any one of the plurality of the frame groups to be sequentially generated by the first unit in displaying the picture, a potential difference of each of the frame groups between the counter electrode and each of the pixel electrodes corresponding to the first pattern, the second pattern or the one half-tone pattern.

With the above configuration, when a picture consisting of a pattern having one color and a pattern having the other color out of two colors to be displayed on a pixel on a display area of the electrophoretic display device with a plurality of pixels (electrophoretic elements) arranged in a matrix form is to be displayed, a frame group corresponding to one color and a frame group corresponding to another color are provided in specified order and when a frame group produced sequentially serves as a frame group having either of the two colors, a potential difference corresponding to the color of the frame group is applied between a pixel electrode corresponding to the pixel for the above pattern and a counter electrode and, therefore, a potential difference to be applied between the pixel electrode of the electrophoretic element and the counter electrode on one picture or between pictures can be freely applied so as to meet a purpose of display on the picture. As a result, an afterimage and/or an image burn-in can be prevented.

With another configurations as above, when a picture of patterns having two different colors and a half tone color between these colors is displayed on a pixel on a display area of the electrophoretic display panel with a plurality of pixels (electrophorretic element) arranged in a matrix form, a frame group to make the electrophoretic element to output a potential difference for every color to be displayed and a potential difference corresponding to the frame in frames sequentially provided for display on a picture is applied between the pixel electrode corresponding to the pixel of the pattern to be displayed by the frame and counter electrode and, therefore, it is made possible to apply a potential difference between the pixel electrode and counter electrode on one picture or between pictures. As a result, when a pattern made up of white and black and a half tone between the white and black is displayed, an afterimage and/or burn-in can be prevented.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

First Embodiment

Figure 1:
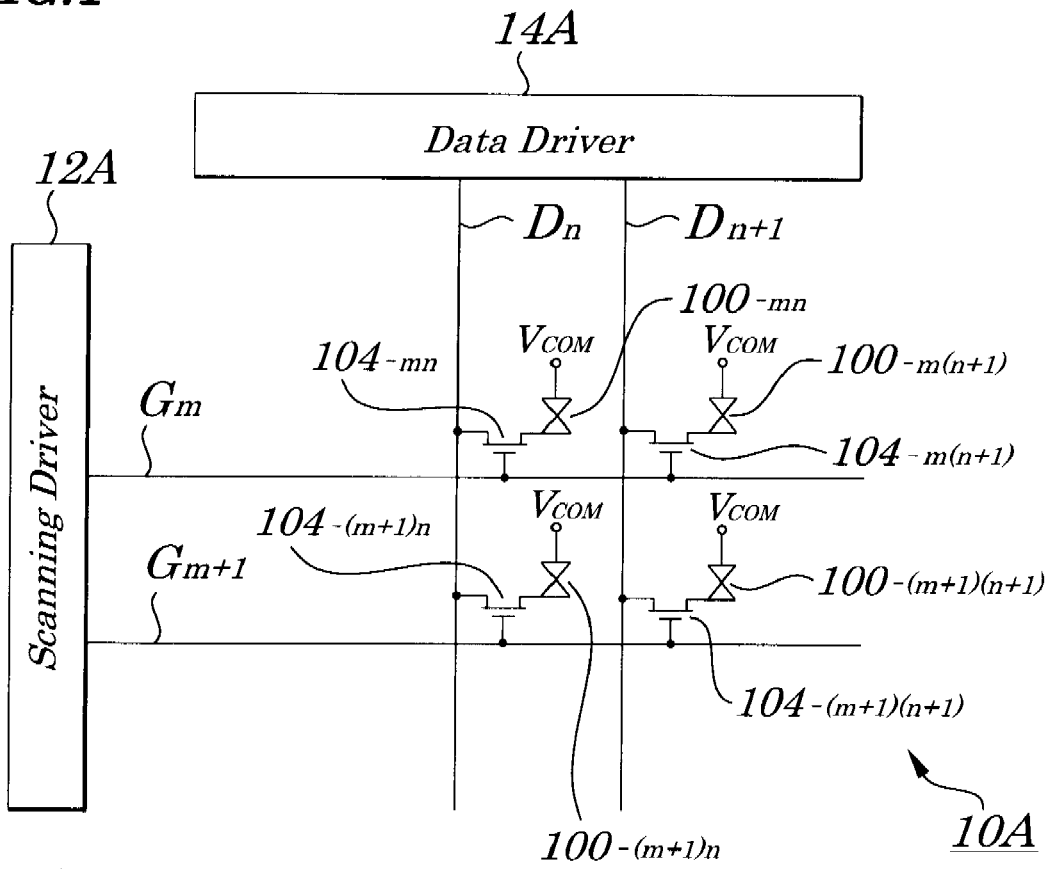
FIG. 1 is a schematic circuit diagram showing configurations of a driving circuit of an electrophoretic display device according to a first embodiment of the present invention.
Figure 2:
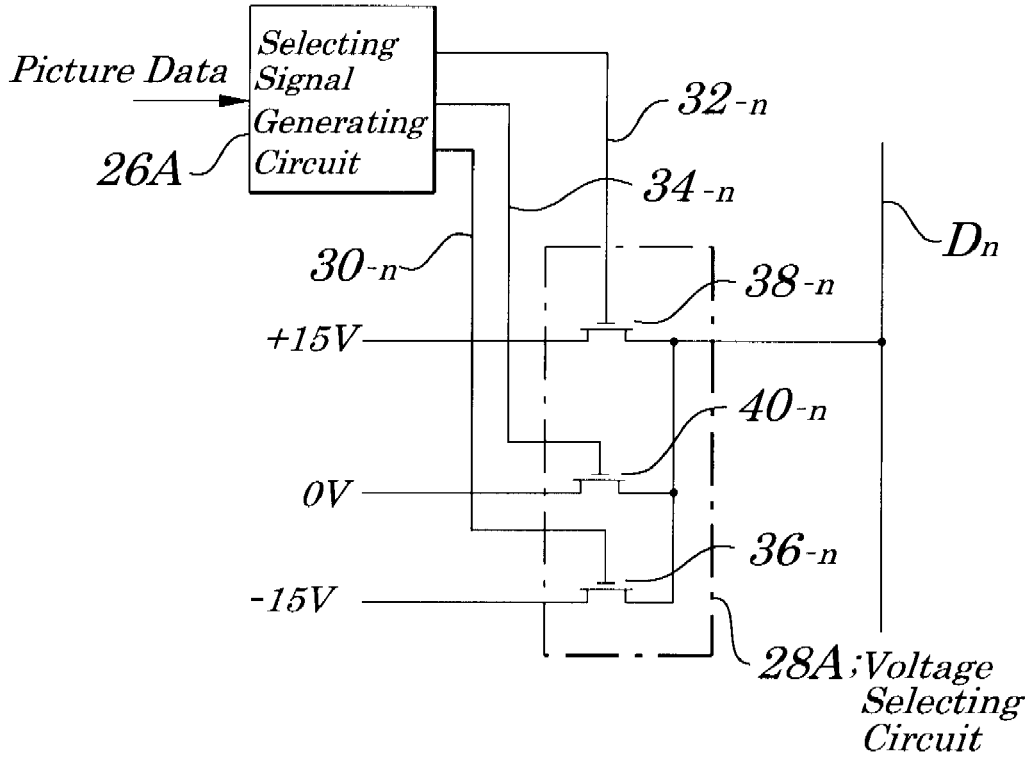
FIG. 2 is a schematic circuit diagram showing configurations of a data driver of the electrophoretic display device according to the first embodiment of the present invention.
Figure 3:
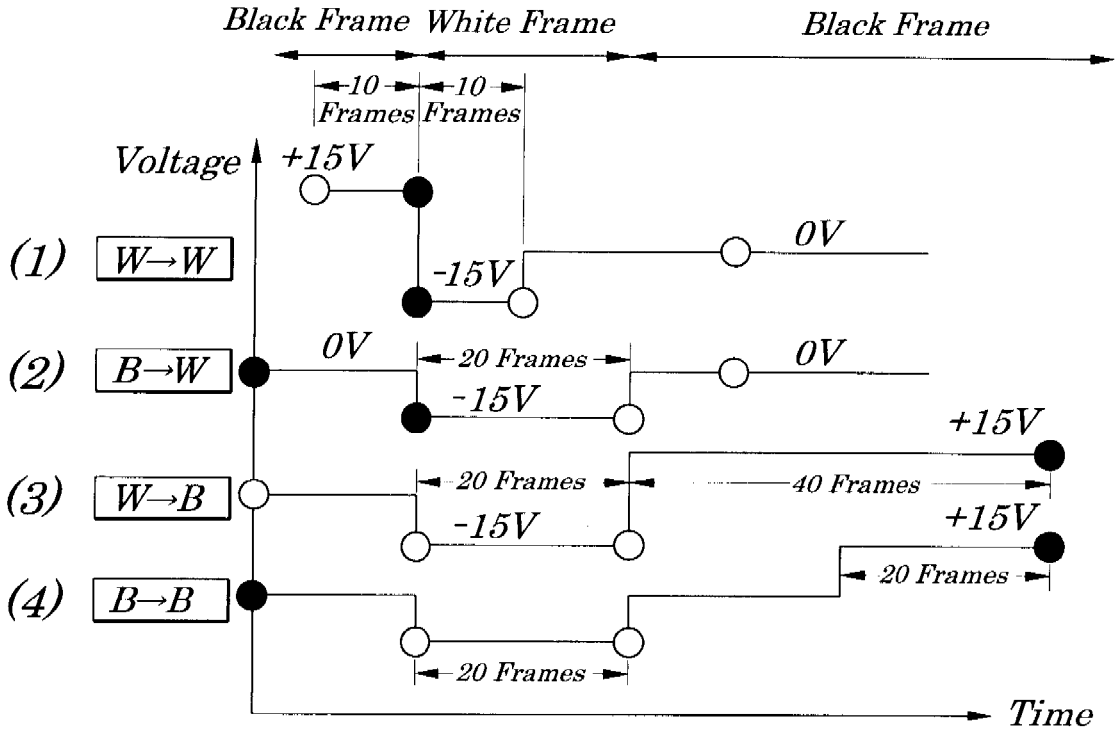
FIG. 3 is a diagram showing driving waveforms of the data driver of the electrophoretic display device according to the first embodiment of the present invention.
Figure 4:
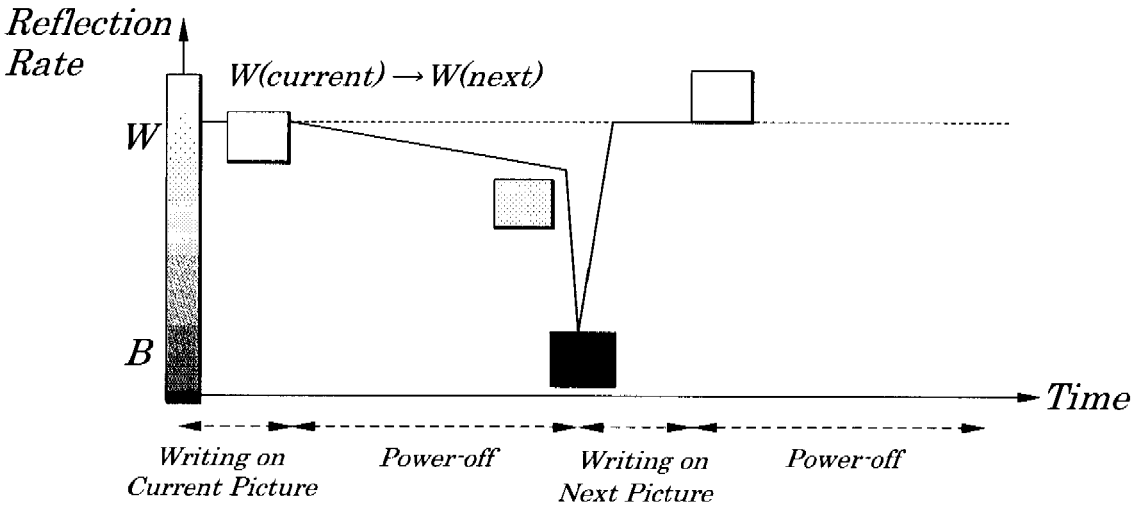
FIG. 4 is a schematic diagram explaining an effect obtained when a black state in a transition state is inserted between a white state and a subsequent white state in driving operations performed in the electrophoretic display device according to the first embodiment of the present invention.
Figure 5:
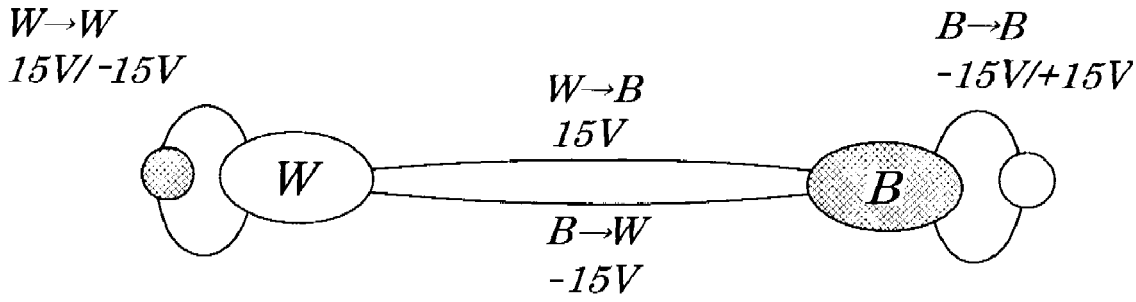
FIG. 5 is a diagram showing changes in a display state in driving the electrophoretic display device according to the first embodiment of the present invention.
Figure 6:
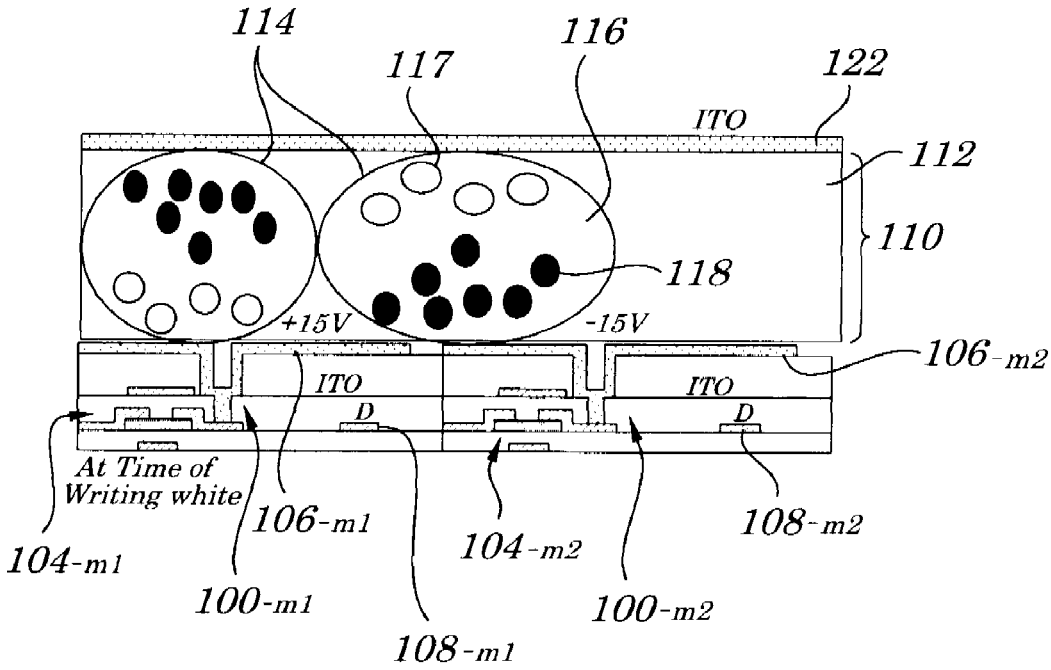
FIG. 6 is a diagram used for explaining a state in which the second afterimage is produced in the electrophoretic display device according to the first embodiment of the present invention.
Figure 7:
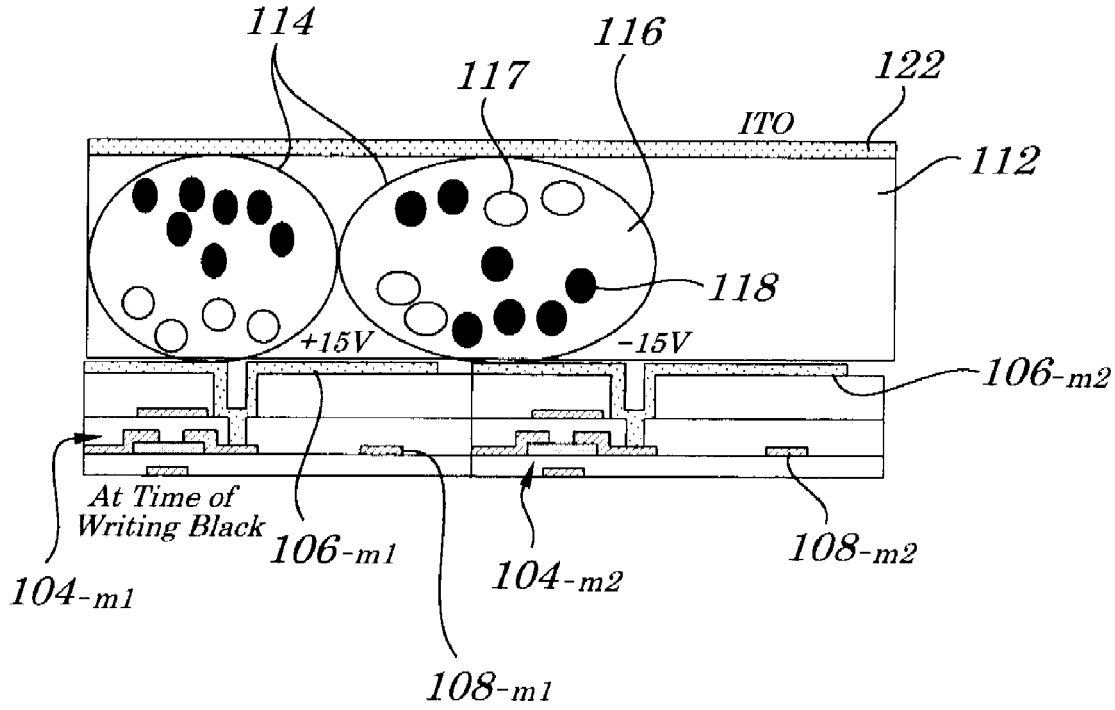
FIG. 7 is a diagram used for explaining a state in which the second afterimage disappears in the electrophoretic display device according to the first embodiment of the present invention.
Figure 8:
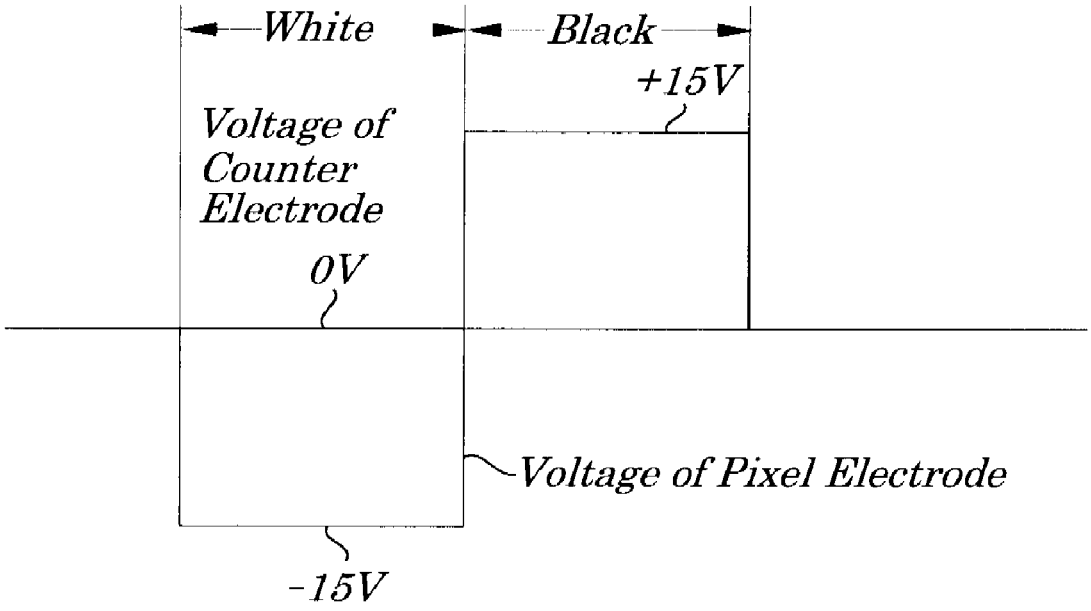
FIG. 8 is a diagram showing a relation between a voltage of a counter electrode and a voltage of a pixel electrode in driving the electrophoretic display device according to the first embodiment of the present invention.

FIG. 1 is a schematic circuit diagram for showing configurations of a driving circuit of an electrophoretic display device of the first embodiment of the present invention. FIG. 2 is a schematic circuit diagram showing configurations of a data driver 14A of the electrophoretic display device 10A according to the first embodiment. FIG. 3 is a diagram showing driving waveforms of the data driver 14A of the electrophoretic display device 10A according to the first embodiment. FIG. 4 is a schematic diagram explaining an effect obtained when a black state in a transition state is inserted between a white state and a subsequent white state in driving operations performed in the electrophoretic display device 10A according to the first embodiment. FIG. 5 is a diagram showing change of display state in driving the electrophoretic display device 10A according to the first embodiment. FIG. 6 is a diagram showing a state in which a second afterimage is produced in the electrophoretic display device 10A according to the first embodiment. FIG. 7 is a diagram showing a state in which the second afterimage disappears in the electrophoretic display device 10A according to the first embodiment. FIG. 8 is a diagram showing a relation between a voltage of a counter electrode and a voltage of a pixel electrode in driving the electrophoretic display device 10A according to the first embodiment.

Figure 25:
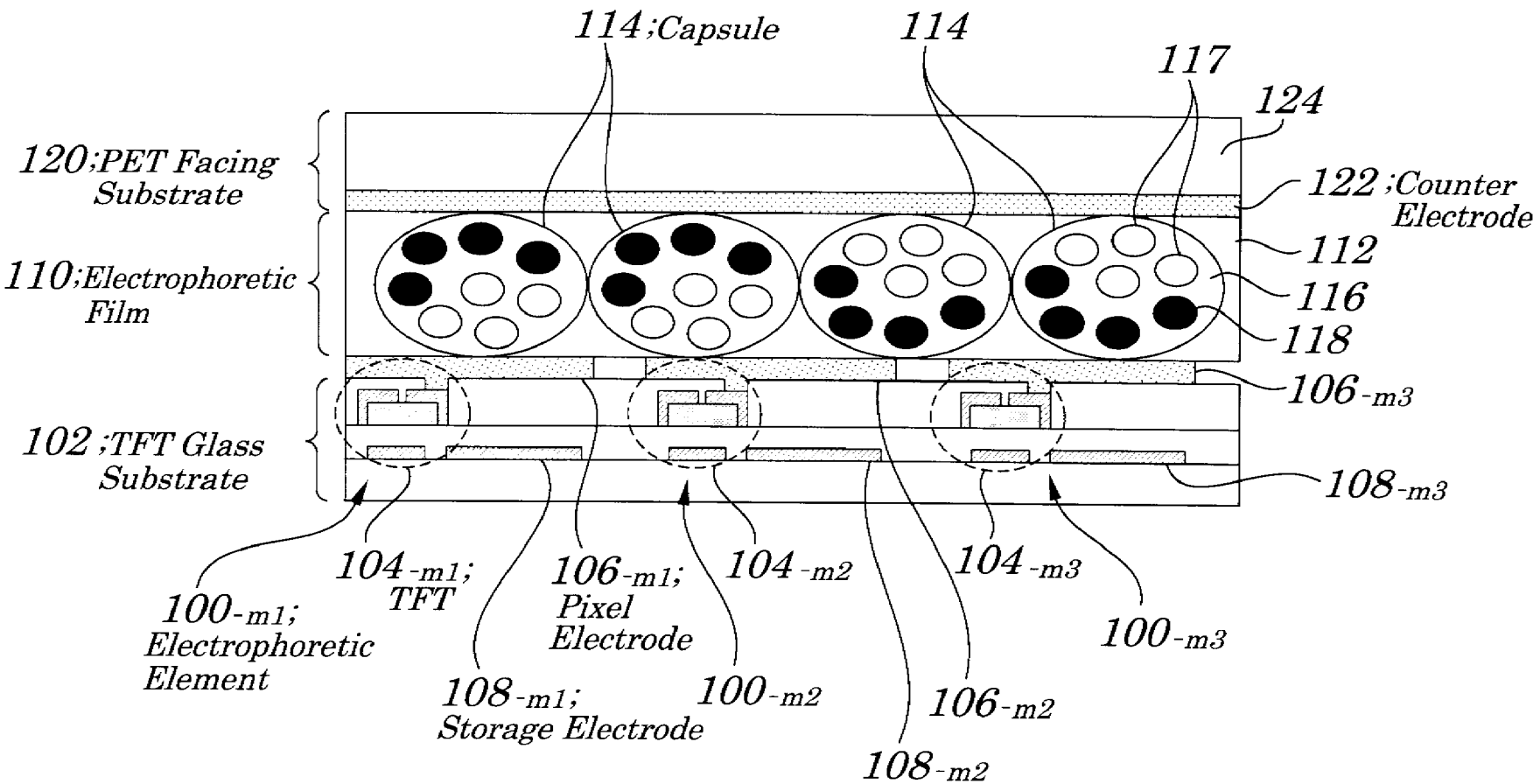
FIG.25 (RELATED ART)
FIG. 25 is an enlarged cross-sectional diagram conceptually showing configurations of a conventional microcapsule-type electrophoretic display panel.
Figure 26:
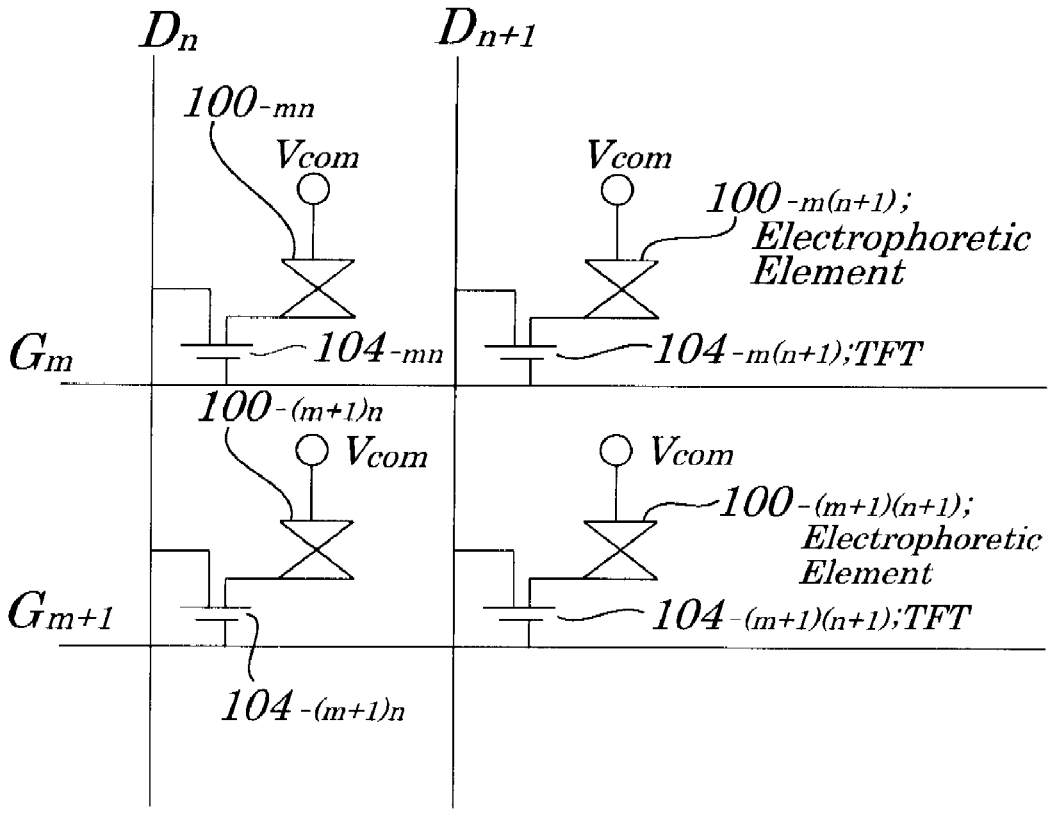
FIG.26 (RELATED ART)
FIG. 26 is a schematic circuit diagram of the microcapsule-type elements arranged in a matrix form, which make up a conventional electrophoretic display device.
Figure 27:
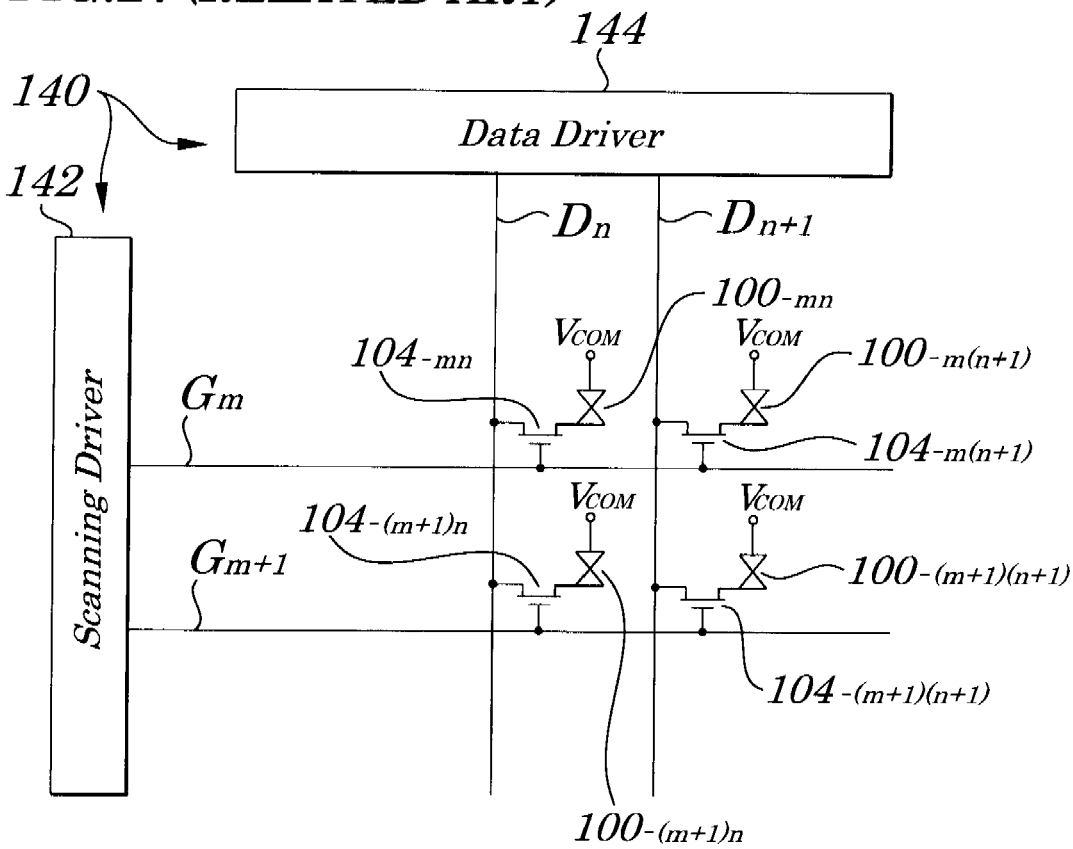
FIG.27 (RELATED ART)
FIG. 27 is a schematic circuit diagram showing a driving circuit of the conventional electrophoretic display device.
Figure 28:
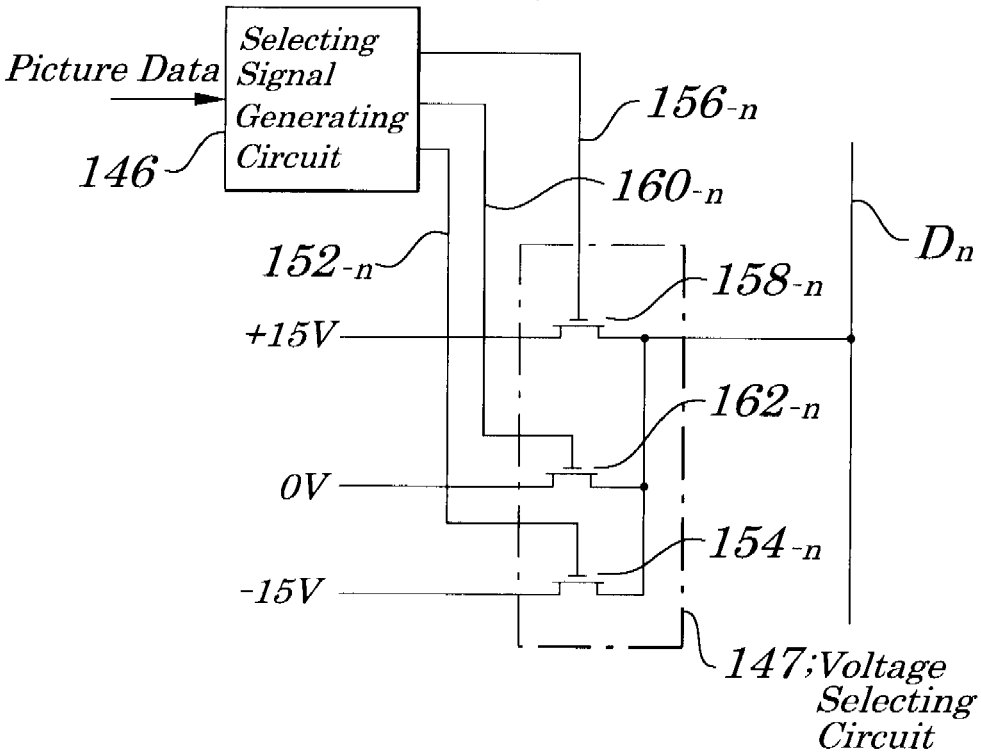
FIG.28 (RELATED ART)
FIG. 28 is a schematic circuit diagram showing part of configurations of a data driver of the conventional electrophoretic display device.
Figure 29:
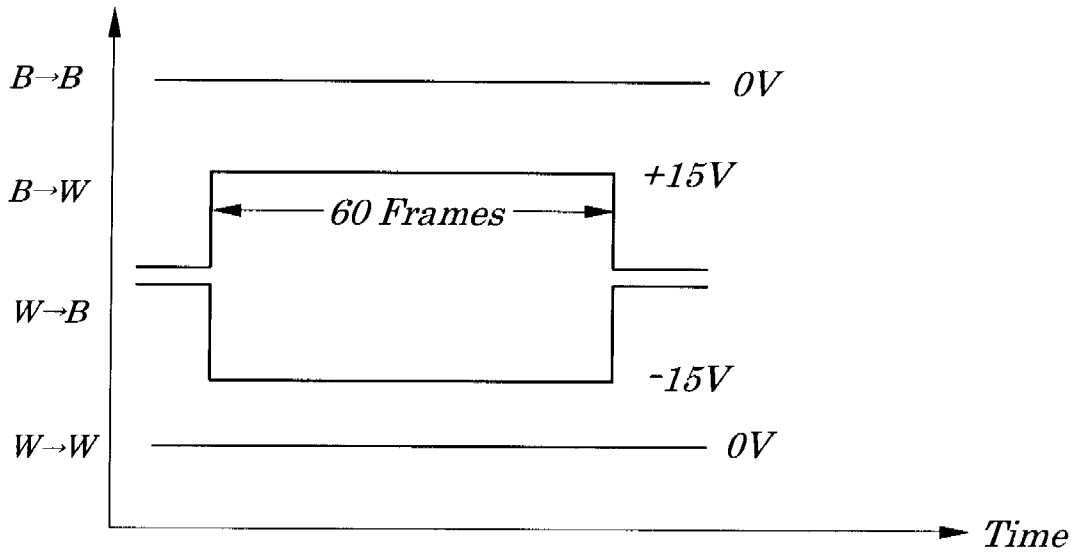
FIG.29 (RELATED ART)
FIG. 29 is a diagram showing driving waveforms of the data driver of the conventional electrophoretic display device.
Figure 30:
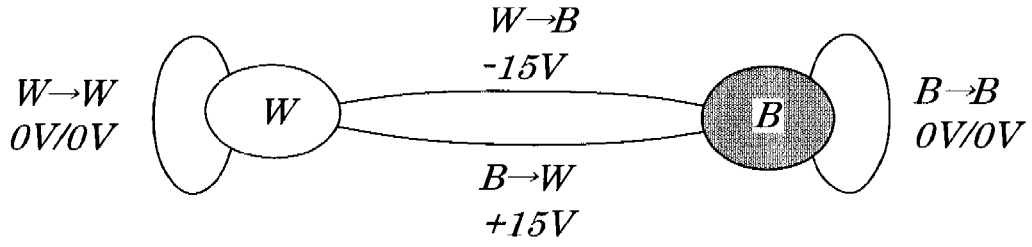
FIG.30 (RELATED ART)
FIG. 30 is a state change diagram explaining driving of the conventional electrophoretic display device.
Figure 31:
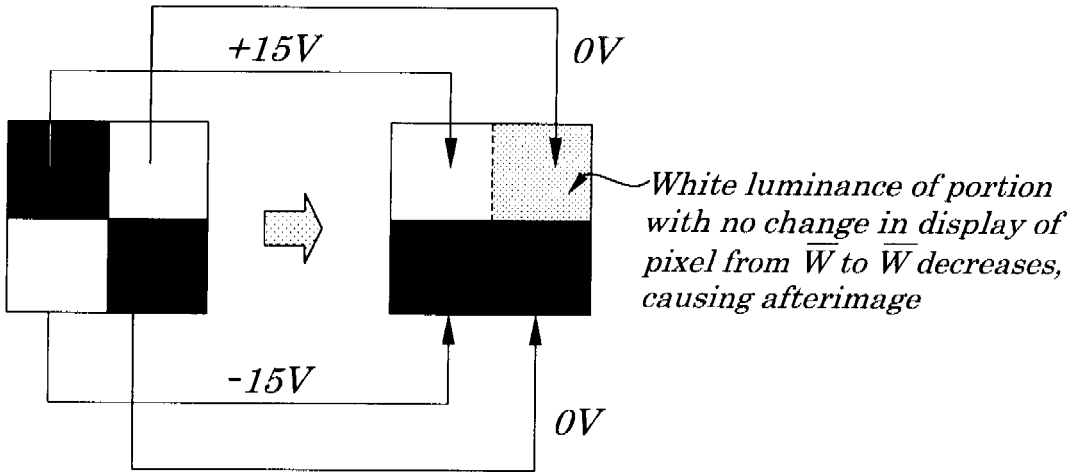
FIG.31 (RELATED ART)
FIG. 31 is a diagram explaining a first afterimage problem of the conventional electrophoretic display device.
Figure 32:
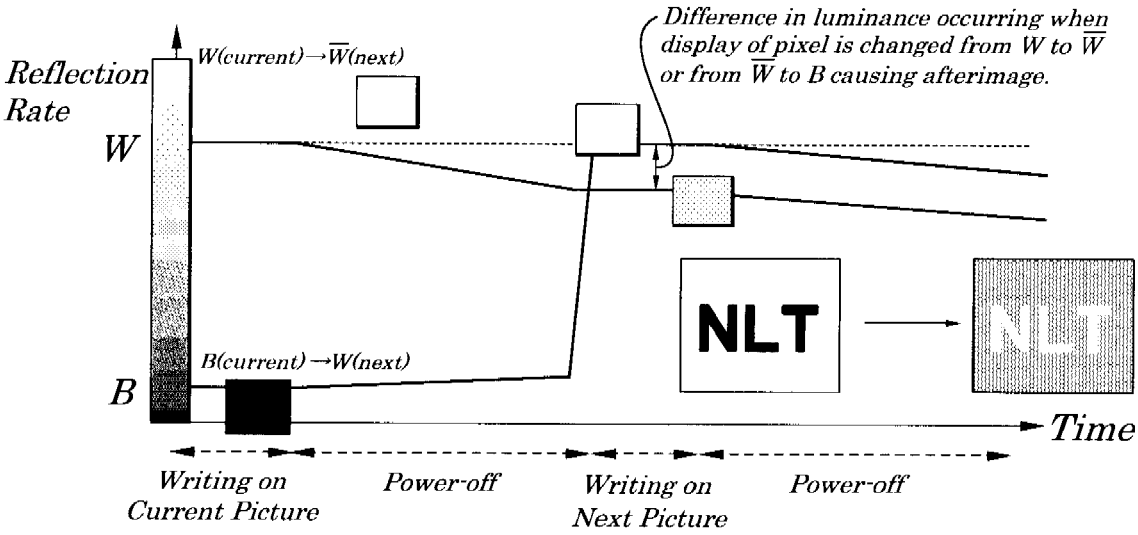
FIG.32 (RELATED ART)
FIG. 32 is a time chart explaining the first afterimage problem of the conventional electrophoretic display device.
Figure 33:
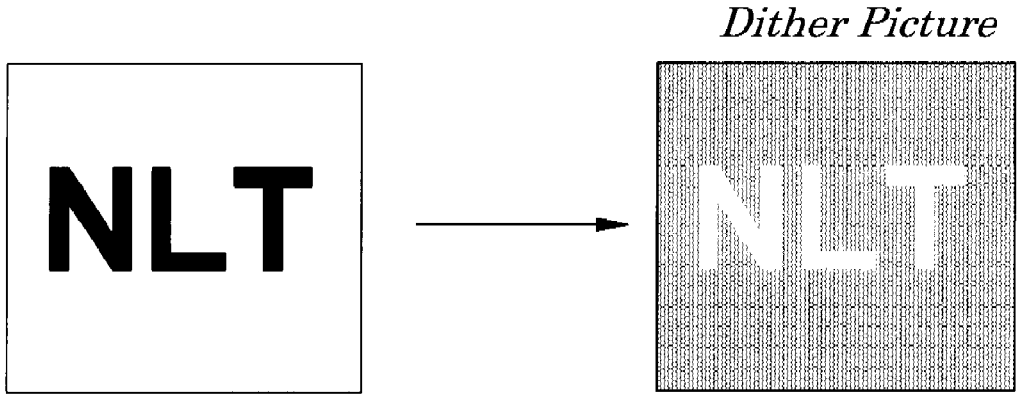
FIG.33 (RELATED ART)
FIG. 33 is a diagram explaining a second afterimage problem of the conventional electrophoretic display device.
Figure 34:
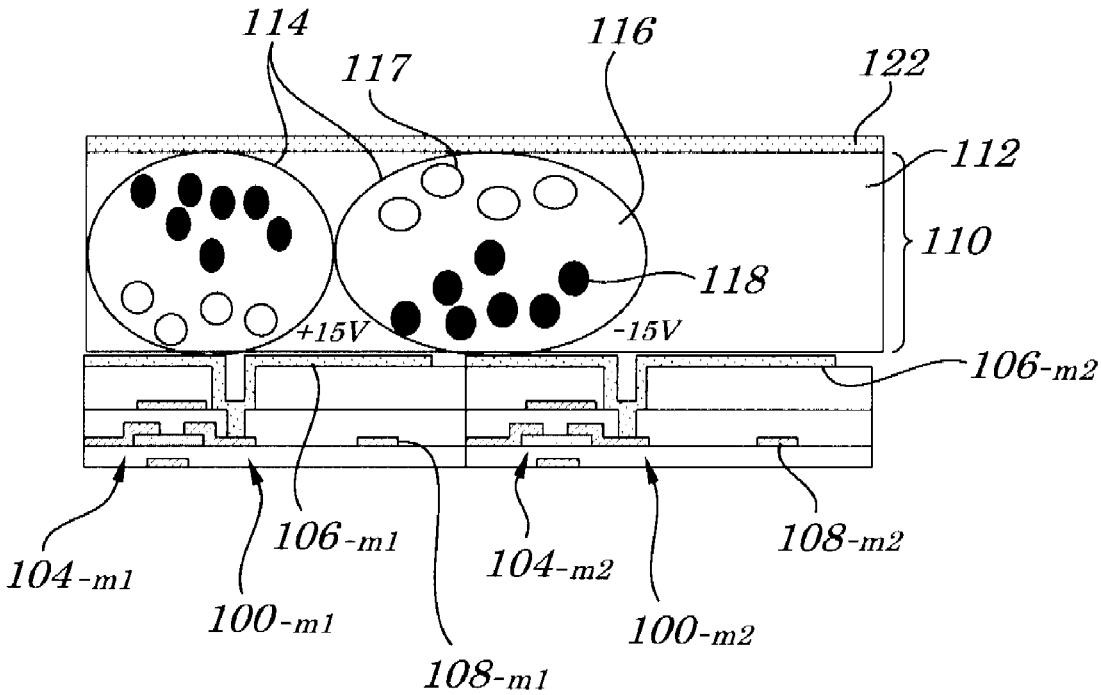
FIG.34 (RELATED ART)
FIG. 34 is a cross-sectional view of the panel of the conventional electrophoretic display device, that is used to explain the second afterimage problem.

The active-matrix driving-type electrophoretic display device 10A of the embodiment is so configured that frames forming a picture are divided into a plurality of white frames and a plurality of black frames and the numbers of frames being used for writing in white is made to coincide with the numbers of frames being used for writing in black in images and among images and a frame for particles having slow mobility responsive to variation in an electric field is provided last in the formation of a given picture. As shown in FIG. 1, the electrophoretic display device 10A is so constructed that its microcapsule-type electrophoretic elements 100-*mn* (m=1, 2, . . . , M; n=1, 2, . . . , N) arranged in m-rows and n-columns in a matrix form are driven by a scanning driver 12A and the data driver 14A. Configurations of the electrophoretic display panel itself are the same as those of the conventional electrophoretic display panel shown in FIG. 25. Therefore, in FIG. 6 and FIG. 7, the same reference numbers are assigned to components having the same function as the conventional electrophoretic display panel shown in FIG. 25 and their descriptions are omitted. The electrophoretic elements 100-*mn* make up the electrophoretic display panel as a whole. The electrophoretic elements 100-*mn* are connected through TFT gates 104-*mm* to scanning lines Gm and to data lines Dn. The scanning driver 12A, if the TFT gates 104-*mn* are made up of p-MOS transistors, serves as a driver to output a gate voltage to scanning lines Gm. A data driver 14A outputs, to data lines Dn, time-series voltages that can prevent the application of DC voltages to the electrophoretic elements 100-*mn* in the total frames needed to rewrite pixels making up the electrophoretic elements 100-*mn*.

The data driver 14A, as shown in FIG. 2, includes the selecting signal generating circuit 26A and the voltage selecting circuit 28A. The selecting signal generating circuit 26A outputs a selecting signal to cause a time-series voltage containing +15V (voltage to be used for writing black), 0V, and −15V (voltage to be used for writing white) to be output from the voltage selecting circuit 28A. The voltage selecting circuit 28A sends out a time-series voltages determined according to the above selecting signal to the data line Dn. The selecting signal is determined depending on pixel data in each picture for an image and is switched according to pixel data in each picture. That is, each picture is formed by specified numbers of black frames and by specified numbers of white frames. The selecting signal to cause switching from W to W and from B to B in each picture and sequential switching from B to W and from W to B among pictures is produced so as to satisfy the following conditions described below (see FIG. 3).

That is, when the electrophoretic elements 100-*mn* are driven in a state where W is displayed repeatedly and continuously on a given picture (in the case of continuous display of W->W->W . . . ), W is written by providing specified numbers of white frames on the picture, however, by providing black frames (as transition frames) before or after the white frames are provided (for example, between the white frames for obtaining the given picture and the white frames for obtaining the subsequent picture), change of display to B is made to occur in an inserted manner; in other words, B is written by providing black frames before W is written by providing the white frames on the picture or B is written by providing black frames after W is written by providing the white frames [see (1) of FIG. 3]. In this case, a voltage to be applied to pixel electrodes 106-*mn* of the electrophoretic elements 100-*mn* when B is written is set to be V+=+15V and a voltage to be applied to the pixel electrodes 106-*mn* of the electrophoretic elements 100-*mn* when W is written is set to be V−=−15V and the number of white frames is set to be Tww− and the number of black frames is set to be Tww+. At this time, the setting must satisfy the following equation:

$$Tww+=Tww- \quad (1)$$

Also, when the electrophoretic elements 100-*mn* are driven in a state where B is displayed repeatedly and continuously on a given picture (in the case of continuous display of B->B->B . . . ), B is written by providing specified numbers of black frames in the picture, however, by providing white frames (as transition frames) before or after the black frames are displayed (for example, between the black frames for obtaining the given picture and the black frames for obtaining the subsequent picture), change of display to W is made to occur in an inserted manner; in other words, W is written by providing white frames before B is written by providing the black frames on the picture or W is written by providing white frames after B is written by providing the black frames [see (4) of FIG. 3]. In this case, a voltage to be applied to the pixel electrodes 106-*mn* of the electrophoretic elements 100-*mn* when the display is switched to B is set to be V+=+15V and a voltage to be applied to the pixel electrodes 106-*mn* of the electrophoretic elements 100-*mn* when the display is switched to W is set to be V−=−15V and the number of white frames is set to be Tbb− and the number of black frames is set to be Tbb+. At this time, the setting must satisfy the following equation:

$$Tbb+=Tbb- \quad (2)$$

Also, when a change of display from W to B is made in a current picture and a change of display from B to W is made in a next picture, a voltage to be applied to the electrophoretic elements 100-*mn* when W is written in the display switching from W to B is set to be V−=−15V and a voltage to be applied to the electrophoretic elements 100-*mn* when B is written in the switching from W to B is set to be V+=+15V and the number of white frames to be used when W is written is set to be Twb(−) and the number of black frames to be used when B is written is set to be Twb(+) and further a voltage to be applied to the electrophoretic elements 100-*mn* when B is written in the switching of display from B to W is set to be V+=+15V and a voltage V− to be applied to the electrophoretic elements 100-*mn* when W is written in the switching of display from B to W is set to be V−=−15V. In these conditions, the following equation is assumed:

$$Twb(+)+Tbw(+)=Tbw(-)+Twb(-) \quad (3)$$

Next, operations of the electrophoretic display device 10A of the first embodiment are described by referring to FIG. 1 to FIG. 7. In the embodiment, each of the electrophoretic elements 100-*mn* making up the electrophoretic display device 10A is changed from a means of displaying W to a means of displaying B or from the means of displaying B to the means of displaying W, the driving method for the electrophoretic elements 100-*mn* is the same as that for the conventional electrophoretic elements except the following points. That is, any picture displaying images is formed by providing a plurality of black frames and a plurality of white frames is displayed in specified time-series order. The number of black frame groups and the number of white frame groups both being sequentially displayed in each picture are different or same.

Switching of a display state on a picture is explained below. In a state in which a signal used to turn ON the TFT gate 104-*mn* was sent out from the scanning driver 12A and a voltage of +15V was applied from the data driver 14A through the data line Dn to the pixel electrode 106-*mn* of the electrophoretic elements 100-*mn* to write B to the electrophoretic elements 100-*mn* so that the electrophoretic elements 100-*mn* operate as the means of displaying black, if the electrophoretic elements 100-*mn* are required to display W by providing white frames in a next picture, a signal to turn ON the TFT gate 104-*mn* is applied to the gate line Gm from the scanning driver 12A and a voltage of −15 is applied from the data driver 14*a* to the pixel electrode 106-*mn* through the data line Dn.

The application of a voltage of −15V to the pixel electrodes of the electrophoretic elements 100-*mn* is described by referring to FIG. 2. The selecting signal generating circuit 26A receiving picture data, when making the electrophoretic elements 100-*mn* display white, outputs a negative voltage to a selecting line corresponding to a pixel, for example, to a selecting line 30-*n* during a pixel period. This causes a pMOS of the voltage selecting circuit 28A, for example, a pMOS 36-*n* to be turned ON and the data line Dn to output a voltage of −15V.

Thus, when the voltage of −15V is applied to the pixel electrodes 106-*mn* of the electrophoretic elements 100-*mn*, positively-charged black carbon particles are attracted by the pixel electrode 106-*mn* and negatively-charged white titanium oxide is driven out toward counter electrode 122. As a result, the electrophoretic elements 100-*mn* switch their display states from black to white [see (2) of FIG. 3].

In a picture subsequent to the picture (next picture described above) displaying a white state, if the electrophoretic elements 100-*mn* are required to display B, a signal to turn ON the TFT gate 104-*mn* is sent out from the scanning driver 12A to the gate line Gm and a voltage of +15V is applied from the data driver 14A through the data line Dn to the pixel electrodes 106-*mn* of the electrophoretic elements 100-*mn*.

The application of a voltage of +15V to the pixel electrodes 106-*mn* of the electrophoretic elements 100-*mn* is described by referring to FIG. 2. The selecting signal generating circuit 26A receiving picture data, when making the electrophoretic elements 100-*mn* display B in the next picture by providing black frames, outputs a negative voltage to a selecting line corresponding to a pixel, for example, to a selecting line 32-*n* for the pixel period. This causes a pMOS of the voltage selecting circuit 28A, for example, the pMOS 38-*n* to be turned ON and a voltage of +15V to be output to the data line Dn.

Thus, when the voltage of +15V is applied to the pixel electrodes 106-*mn* of the electrophoretic elements 100-*mn*, negatively-charged titanium oxide particles in white are attracted by the pixel electrode 106-*mn* and positively-charged carbon particles in black are driven out toward the counter electrode 122. As a result, the electrophoretic elements 100-*mn* switch their display states from W to B [see (3) of FIG. 3].

In FIG. 3 showing the specified example of driving, the reason why a voltage for white display is applied once when the display is switched from W to B is that, since the black frames continue during a period corresponding to 40 frames when the display is switched from W to B, if the white frames continue during a period corresponding to 20 frames when the display is switched from B to W, an asymmetrical state occurs and, therefore, the voltage for the white display is applied during a period while 20 frames are displayed. As explained above, when the electrophoretic elements 100-*mn* switch repeatedly their display states from W to B and from B to W for every picture, the number of black frames for B display and the number of white frames for W display are set so as to satisfy the equation (3) described above. Owing to this, a DC voltage is not applied to the electrophoretic elements 100-*mn*, thereby preventing the occurrence of the burn-in problem.

The driving method to be employed when the electrophoretic elements 100-*mn* switch their display states from W to W and from B to B is as follows. That is, in the case of driving employed when the electrophoretic elements 100-*mn* switch display from W to W on a given picture, as shown in (3) of FIG. 3, when W is displayed on a given picture, a black frame is inserted before a white frame or between the white frames on the picture. By driving as above, the number of black frames Tww+ to be inserted is made to be equal to the number of the white frames to be inserted after the black frame is displayed. In this case, in order to write B by providing the black frame and W by providing the white frame, a voltage is applied to the pixel electrodes 106-*mn* of the electrophoretic elements 100-*mn* by the data driver shown in FIG. 2. The method of applying the voltage is the same as described when the switching between W to B or B to W displaying was explained and its detailed description is omitted accordingly.

Also, in the case of driving employed when the electrophoretic elements 100-*mn* switch their display states from B to B on a given picture, as shown in (4) of FIG. 3, when B is displayed on a given picture, a white frame (as a transition frame) is inserted before or after the black frame is displayed on the picture. The number of black frames Tbb+ to be inserted as above is made to be equal to the number of the white frames to be inserted after the black frame is displayed. In order to write B by providing the black frame and W by providing the white frame, a voltage is applied to the pixel electrodes 106-*mn* of the electrophoretic elements 100-*mn* and the method of applying the voltage is the same as described when the display is switched from W to W in a given picture.

The result from an experiment made by the inventor has confirmed that, according to the driving method of the embodiment, as shown in FIG. 4, when the electrophoretic elements 100-*mn* switch their display states from W to W, by inserting the B display between the W display and W display, it is made possible to prevent charge-up in the electrophoretic elements 100-*mn* and occurrence of an image burn-in and, additionally, since a picture is displayed by the application of a negative voltage (voltage for white), a decrease in white luminance (first afterimage described above) can be prevented more compared with the case where a white state is maintained by memory characteristic of the microcapsule-type electrophoretic element. Moreover, when the display is switched from B to B, by inserting white display between B and B display, an increase in black luminance (first afterimage described above) can be prevented more compared with the case where a black state is maintained by memory characteristic of the microcapsule-type electrophoretic element.

State changes in driving of the embodiment are shown in FIG. 5. In FIG. 5, the 15V in the "15V/−15V" for "W->W" is a voltage to be used for inserting the B display between the W and W display and the "−15V" is a voltage to be used for switching the display from B to W after the display has been switched from W to B. Also, the −15V in the −15V/15V for "B->B" is a voltage to be used for inserting the W display between B and B display and the "15V" is a voltage to be used for switching the display from W to B after the display has been switched from B to W.

As described above, when switching of display from W to B (number of frames being T1) and then to W (number of frames T2) is made to occur in a given picture, T1 is made to be equal to T2 and when switching of the display from B to W (number of frames T3) and then to B (number of frames 4) is made to occur in a given picture, T3 is made equal to T4.

The described problem of the second afterimage occurs due to the reason that, in the case where a pixel electrode is a small and fine pattern with the size of 100 μm to 150 μm, particles contained in the microcapsule making up the electrophoretic element are affected by a leakage electric field generated by a pixel voltage in the neighboring electrophoretic element. The second afterimage problem occurs even if no voltage is applied to a pixel electrode of an electrophoretic element or a voltage is applied, so long as there is a leakage electric field from an electrophoretic element adjacent to the current electrophoretic element.

The occurrence of the second afterimage depends on a difference in charged amounts of different particles contained in a microcapsule. It is difficult to make the charged amount of white particles in the microcapsule be equal to the charged amount of black particles in the microcapsule. The inventor's evaluation of electrophoretic display devices shows that, since a charged amount of TiO (Titanium Oxide) particles being white particles is larger than that of carbon particles being black particles, the white particles move earlier than the black particles. Therefore, if the microcapsules are interposed between the pixel electrodes, a surface of the microcapsule becomes white and white particles invade a neighboring pixel (see FIG. 6) in which the black display is damaged.

To solve this problem, the driving method is employed in which white frames to be written on a given picture are separated from black frames to be written and frames having less charged amounts of particles, less mobility of particles, or a like, that is, black frames, which are selected based on the inventor's evaluation, are written last in the formation of the given picture, and the number of black frames is set to become a specified number. By employing this driving method, though white particles invade a neighboring pixel once, black is written next and, therefore, black particles and white particles can be separated from one another in a microcapsule on a border among pixels in terms of regional separation (see FIG. 7) and the second afterimage problem can be solved. The reason why the black particles do not invade a neighboring pixel electrode is thought to be that a charged amount, mobility, or a like of black particles are smaller than those of white particles and that the number of writing frames is optimized.

It is demonstrated that the driving methods described above serve to solve the first and the second afterimage problems, the image burn-in problem described in the chapter of the "Description of the Related Art". To describe the above driving method briefly, frames to be written into the electrophoretic element are separated from one another and frames having fewer charged amounts of particles are written last in the formation of a given picture. When display is switched from W to W, B is written by providing a black frame (as a transition frame) being displayed before or after W to be written by providing a white frame on a picture in a manner in which the equation (1) described above is satisfied. Also, when display is switched from B to B, W is written by providing a white frame (as a transition frame) existing before or after B to be written by providing a black frame on a picture in a manner in which the equation (2) described above is satisfied. Further, when display is switched from W to B on a current picture and when display is switched from B to W on a next picture, writing is performed in a manner in which the equation (3) described above is satisfied.

Thus, according to the first embodiment, a picture is formed by a specified number of white frames and a specified number of black frames both being separated from one another and when display is switched from W to W on a given picture, B is written before or after writing of W and the number of writing frames for W and B is so set as to satisfy the equation (1) and, therefore, the first afterimage problem and the image burn-in problem occurring when display is switched from W to W can be solved. Also, when display is switched from B to B on a given picture, W is written before or after writing of B and the number of writing frames for B and W is so set as to satisfy the equation (2) and, therefore, the first afterimage problem and the image burn-in problem occurring when display is switched from B to B can be solved. Moreover, writing of a black frame last in the formation of a given picture serves to solve the second afterimage problem.

Second Embodiment

Figure 9:
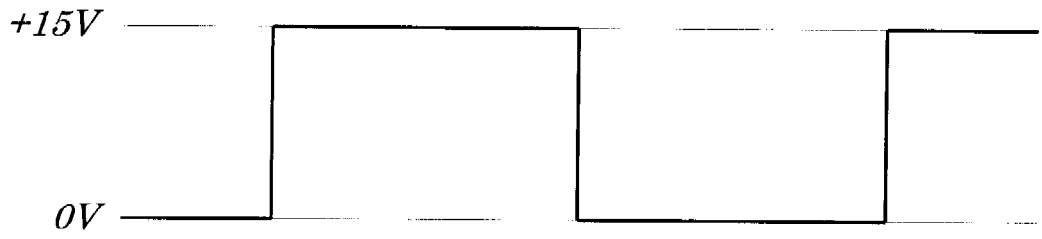
FIG. 9 is a diagram showing a waveform of a voltage to be applied to a counter electrode in driving of an electrophoretic display device according to a second embodiment of the present invention.

FIG. 9 is a diagram showing waveforms of a voltage to be applied to a counter electrode in driving of an electrophoretic display device according to a second embodiment of the present invention.

Configurations of the electrophoretic display device of the second embodiment differ greatly from those employed in the first embodiment in that an electrophoretic element of the electrophoretic display device is driven by using a binary driver. More specifically, the driving method employed in the first embodiment is a dot-inversion driving method in which a COM (common) voltage is not swung, that is, Vcom=0V and, as a H driver (data driver), a ternary driver using ternary voltages of +15V, 0V, and −15V (see FIG. 8). In other words, the ternary driver is a driving driver which keeps a voltage of the counter electrode (COM voltage) at 0V all the time and makes a voltage of a pixel electrode be −15V for a white frame and be +15V for a black frame. The second embodiment is characterized in that the binary driver, instead of the ternary driver, is used as the data driver for driving the electrophoretic element in a manner described below.

More specifically, in the driving by using the binary driver, a voltage to be applied to a pixel electrode is +15V or 0V for both the white frame or the black frame and, when display is switched by providing the white frame in such a way as described above, the COM voltage is set to be 15V and, when display is switched by providing the black frame, the COM voltage is swung from 0V to +15V to obtain 0V as the COM voltage. By configuring as above, in the case of the white frame, when the voltage of +15V is applied to the counter electrode (shown as a solid-line section for +15V in FIG. 9) and a voltage of +15V is applied to the pixel electrode, a difference in potential between the pixel electrode and the counter electrode becomes 0V and the voltage of +15V is applied to the counter electrode (shown as a solid-line section for +15V in FIG. 9) and the voltage of 0V is applied to the pixel electrode, a difference in potential between the pixel electrode and counter electrode becomes −15V.

Also, in the case of the black frame, when the voltage of 0V is applied to the counter electrode (shown as a solid-line section for 0V in FIG. 9) and the voltage of +15V is applied to the pixel electrode, a difference in potential between the pixel electrode and counter electrode becomes +15V and the voltage of 0V is applied to the counter electrode (shown as a solid-line section for 0V in FIG. 9) and the voltage of 0V is applied to the pixel electrode, a difference in potential between the pixel electrode and counter electrode becomes 0V. Therefore, even when the binary driver is used, by performing the driving method as described above, the same driving as the ternary driver can provide is made possible.

Thus, according to the second embodiment, the same effect as achieved in the first embodiment can be realized by using the binary driver, enabling reduction in costs.

Third Embodiment

Figure 10:
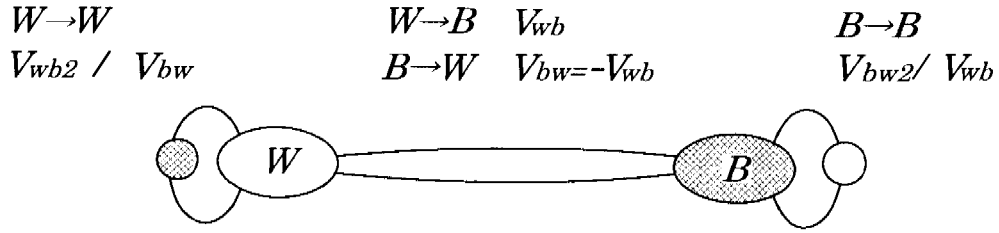
FIG. 10 is a diagram showing changes in driving an electrophoretic display device according to a third embodiment of the present invention.
Figure 11:
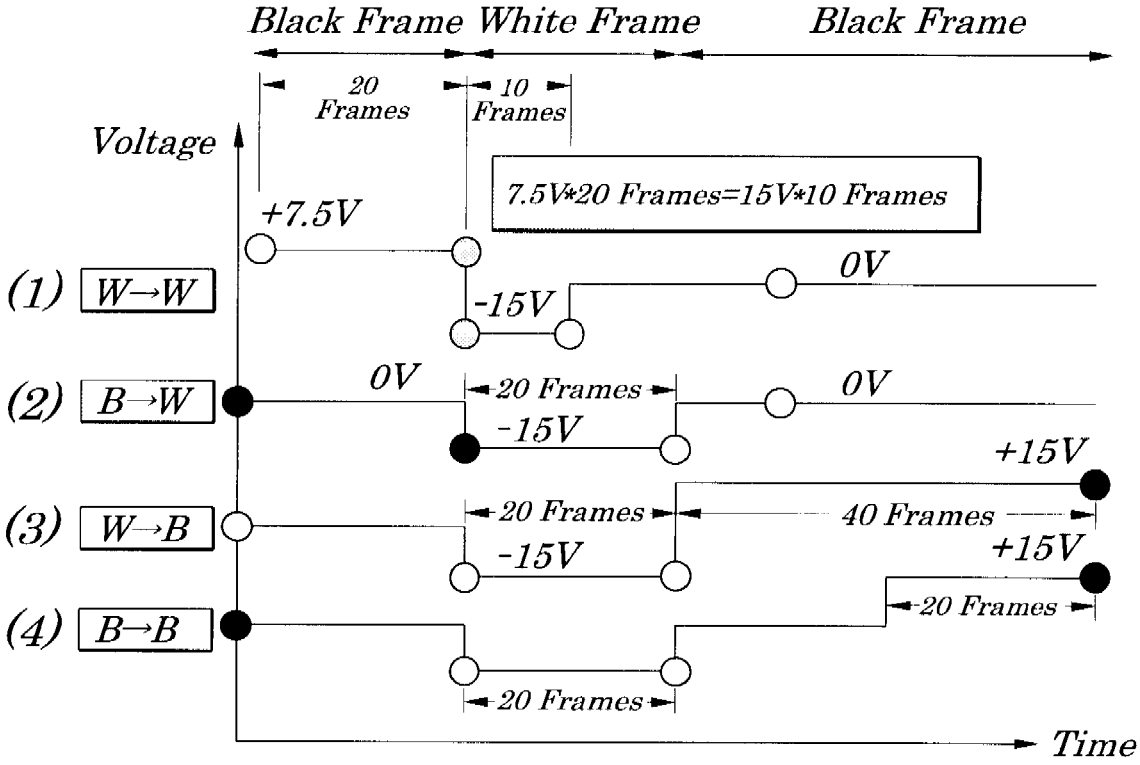
FIG. 11 is a diagram showing a waveform explaining the driving of the electrophoretic display device according to the third embodiment of the present invention.
Figure 12:
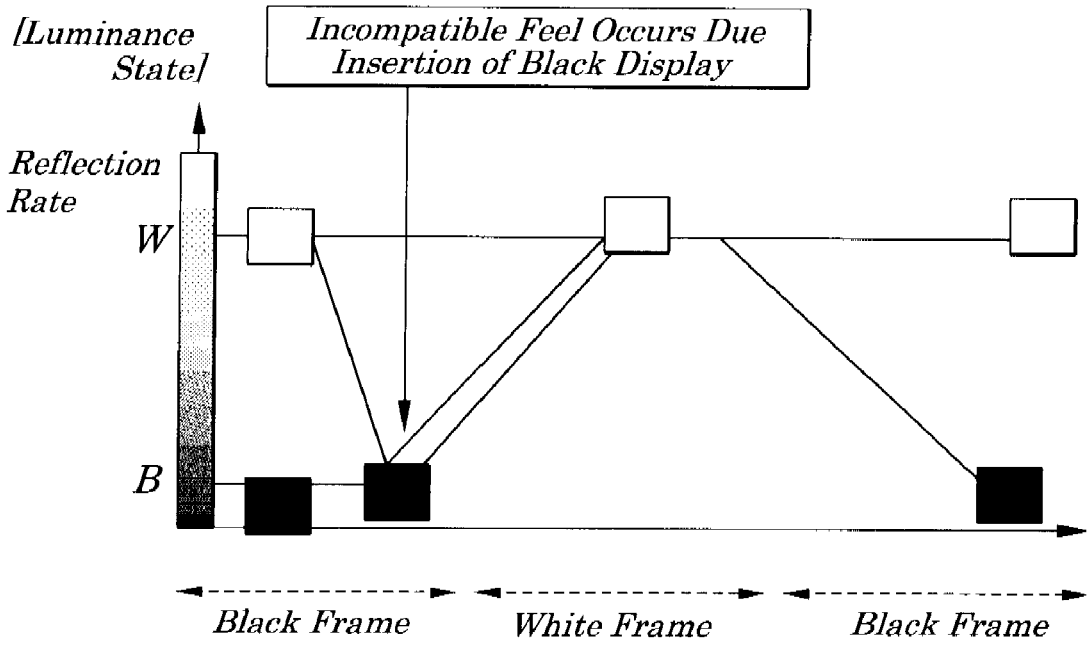
FIG. 12 is a time chart explaining a state of luminance in the first and second embodiments of the present invention.
Figure 13:
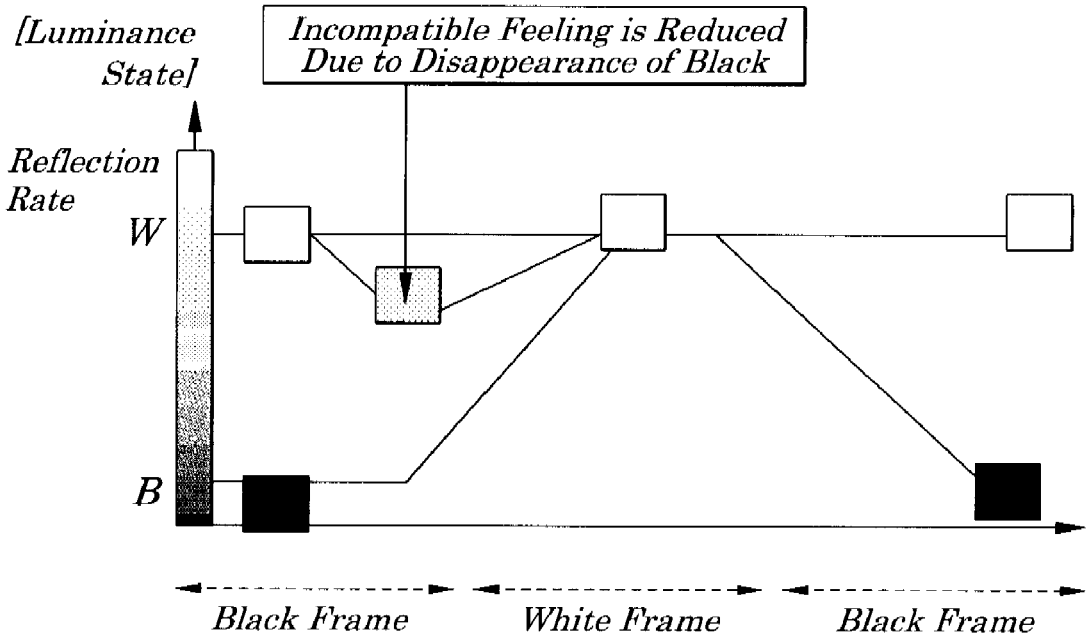
FIG. 13 is a time chart explaining a state of luminance in the third embodiment of the present invention.

FIG. 10 is a diagram showing changes in driving an electrophoretic display device according to a third embodiment of the present invention. FIG. 11 is a diagram showing waveforms explaining the driving of the electrophoretic display device according to the third embodiment of the present invention. FIG. 12 is a time chart explaining a state of luminance in the first and second embodiments. FIG. 13 is a time chart explaining a state of luminance in the third embodiment. Configurations of the electrophoretic display device of the third embodiment differ greatly from those employed in the first and second embodiments in that a flickered-display state occurring when a picture is switched, which occurs in the first and second embodiments, is prevented.

That is, in the electrophoretic display device of the third embodiment, in the switching of display from W (White) to B (Black) and then to W (White), a voltage of +V (Vwb), for example, a voltage of +15V is not applied while black frames are displayed when the display is switched from W to B and, as shown in FIGS. 10 and 11, an intermediate potential (Vwb2) which makes an electrophoretic element display light gray (LG), for example, a voltage of +7.5V is applied and then the voltage of −15V is applied while white frames are displayed. In the switching of display from B to W and then to B, a voltage of +V (Vwb), for example, a voltage of −15V is not applied while white frames are displayed when the display is switched from B to W and an intermediate potential (Vwb2) which makes an electrophoretic element display dark gray (DG), for example, a voltage of +12V is applied and then the voltage of +15V is applied while black frames are displayed.

Additionally, the number of frames T1 for which the intermediate potential Vwb2 is applied and the number of frames T2 for which the intermediate potential Vbw2 is applied are so set as to satisfy the following equation (4):

$$Vwb2 \times T1 = Vbw2 \times T2 \quad (4)$$

This can suppress the occurrence of a DC potential (charge-up) in an electrophoretic film. By satisfying the above equation (4), the charge-up can be suppressed, however, even if the above equation (4) is satisfied, the problem of movement of black particles in a microcapsule cannot be solved, that is, an amount of movement of the black particles is not the same in the microcapsule. This is because, if a voltage is low, an amount of movement of the black particles is small.

In the first and second embodiments, as shown in FIG. 12, when display is switched from W to B and then to W, flashing, that is, flickering glare occurs during the display of white, black and then white. However, by employing the driving method of the third embodiment, the white and light gray and then white are displayed, thus greatly reducing abnormally perceived visual effects occurring in displaying. Also, in the first and second embodiments, when display is switched from B to W and then to B, flashing, that is, flickering glare occurs during the display of black, white and then black. However, by employing the above driving method of the third embodiment, the black and the dark gray and then black are displayed in this order, thereby greatly reducing abnormally perceived visual effects occurring on a picture.

Thus, according to the third embodiment, not only the same effects as obtained in the first and second embodiments but also reduction in flashing can be achieved, thus improving the quality of display.

Fourth Embodiment

Figure 14:
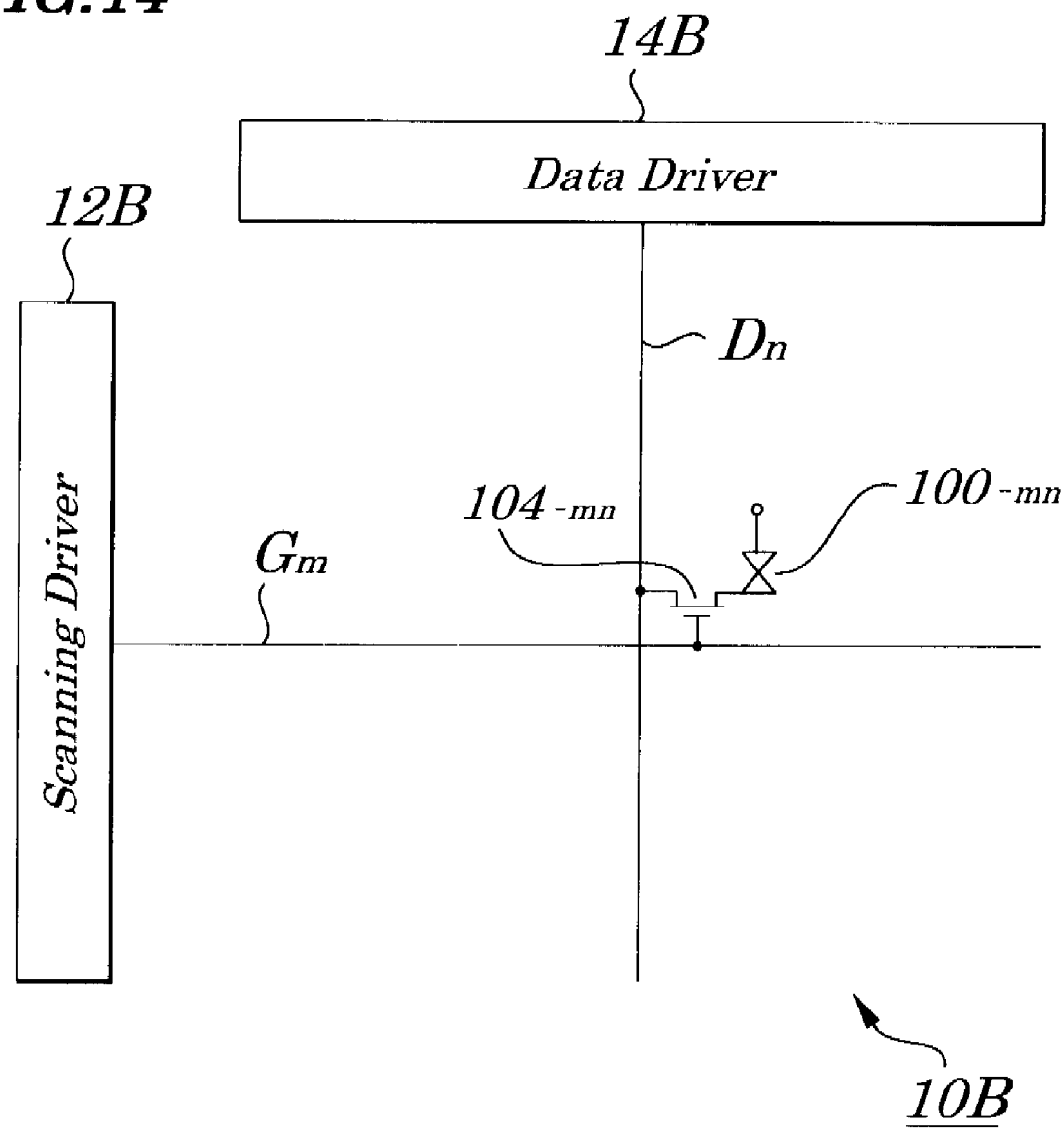
FIG. 14 is a schematic diagram showing configurations of a driving circuit of a microcapsule-type electrophoretic display device according to a fourth embodiment of the present invention.
Figure 15:
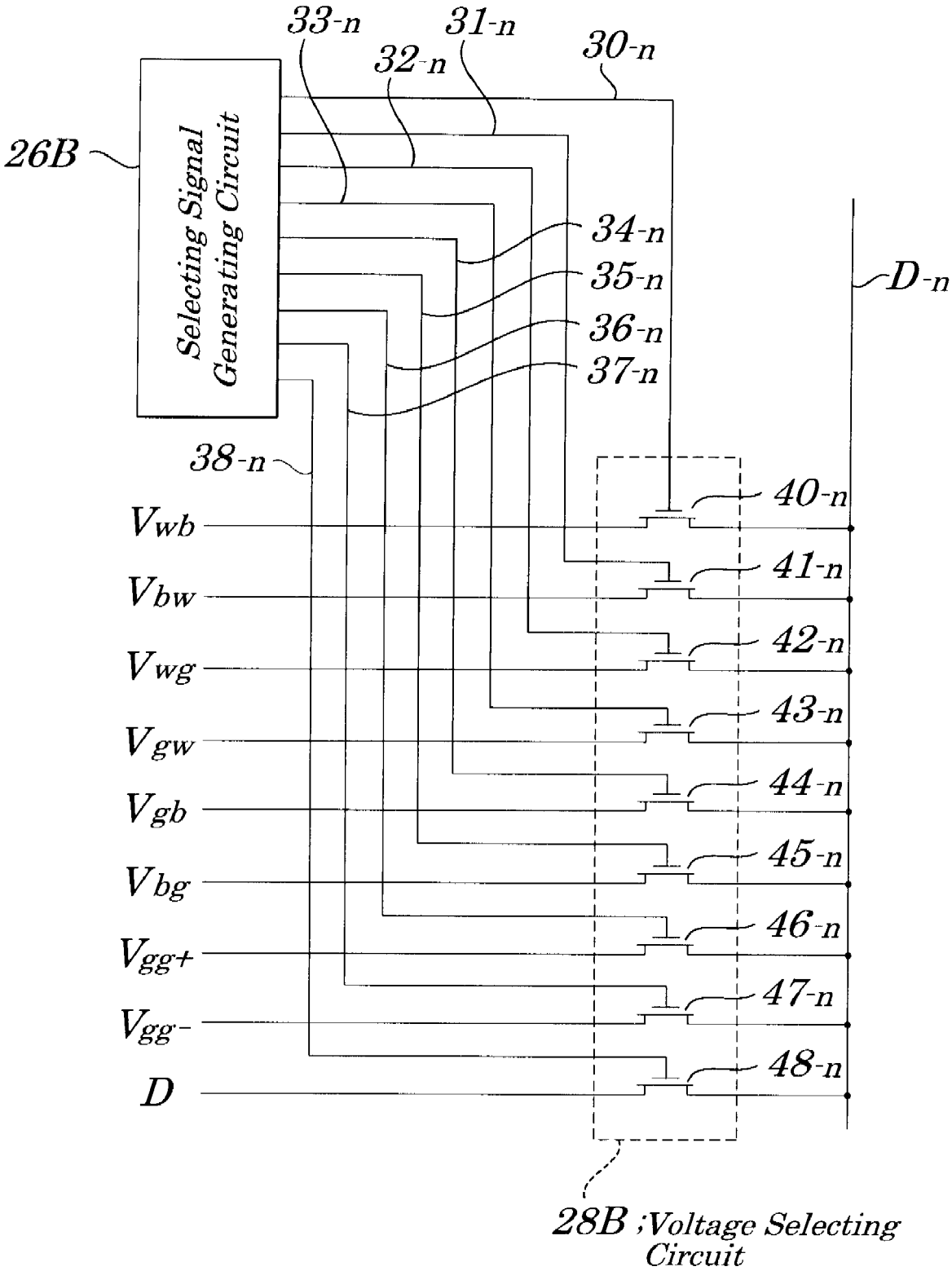
FIG. 15 is a schematic diagram showing configurations of a data driver of the microcapsule-type electrophoretic display device according to the fourth embodiment of the present invention.
Figure 16:
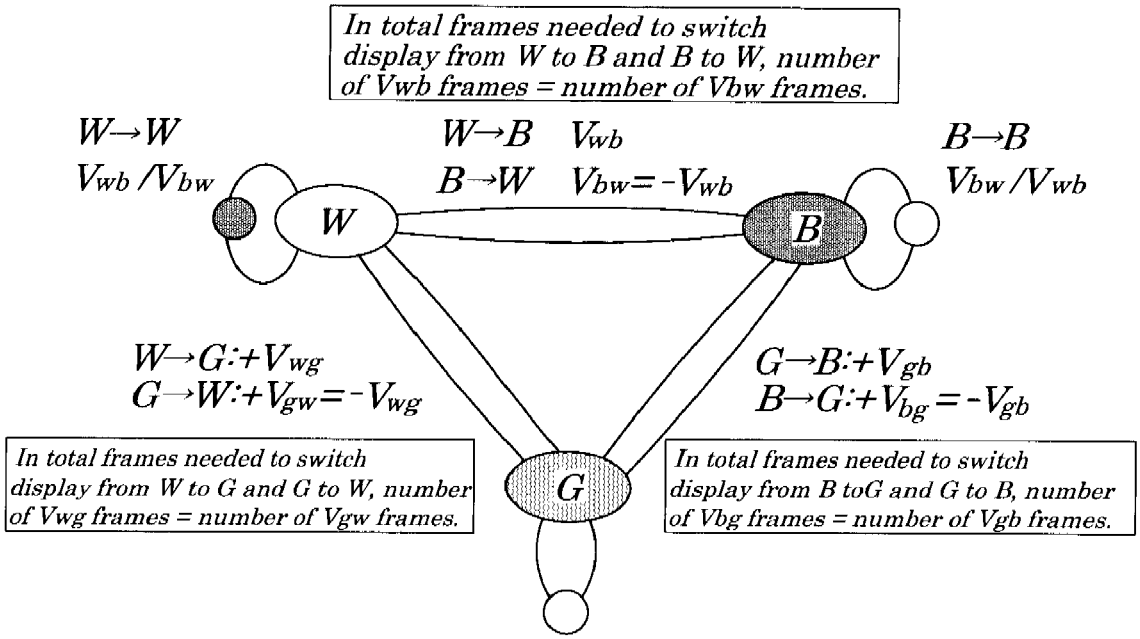
FIG. 16 is a diagram showing changes in driving the microcapsule-type electrophoretic display device according to the fourth embodiment of the present invention.
Figure 17A:
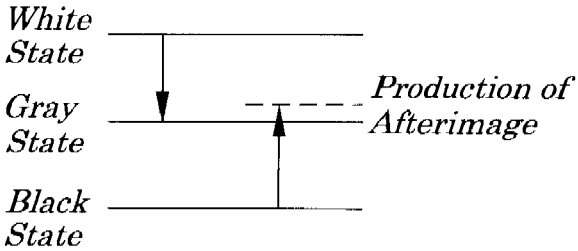
FIGS. 17A and 17B are diagrams showing a relation between an afterimage and applied voltage in the electrophoretic display device according to the fourth embodiment of the present invention.
Figure 17B:
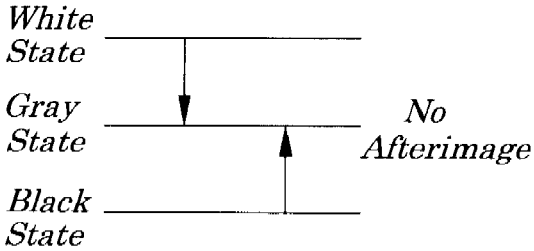
Figure 18:
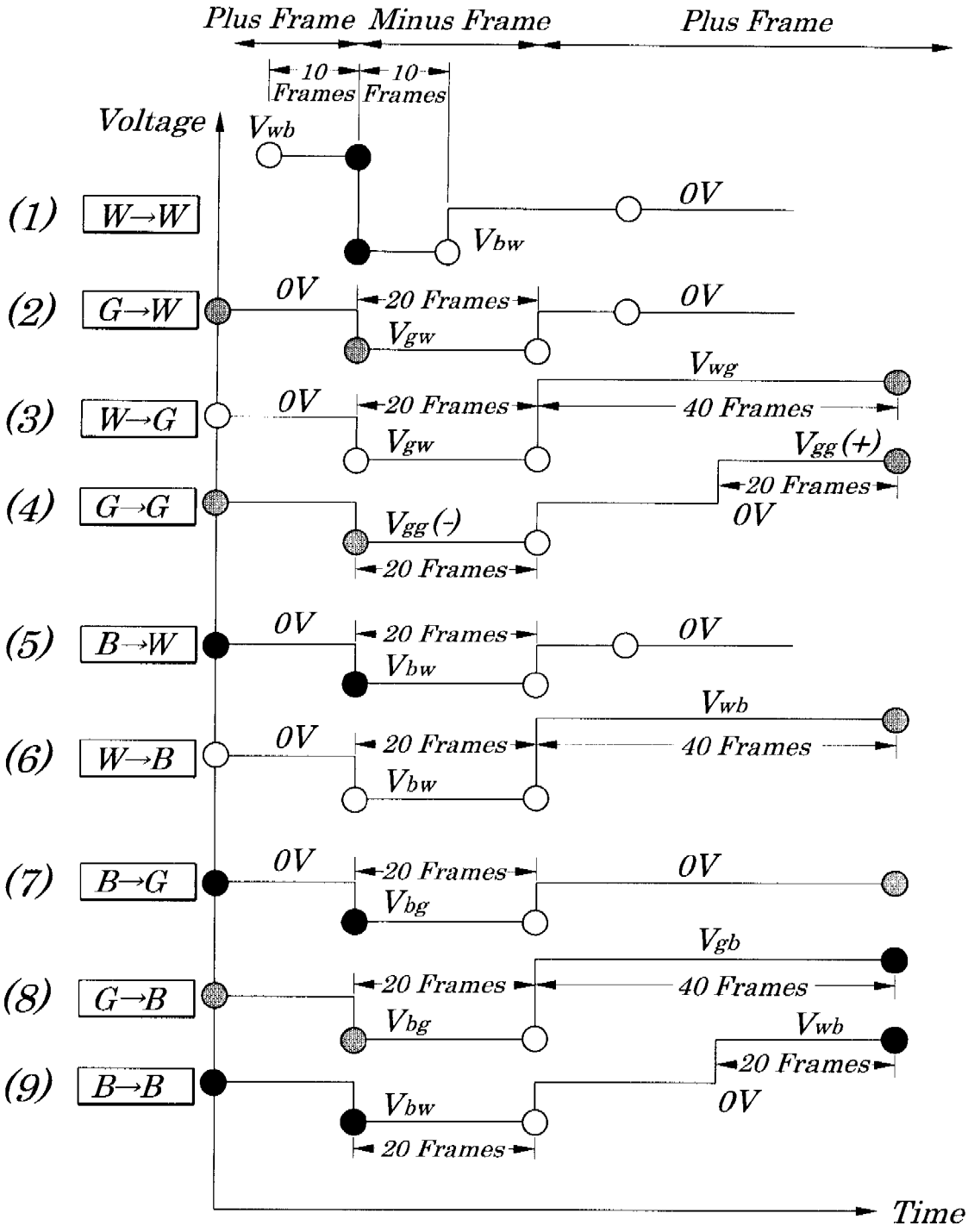
FIG. 18 is a diagram showing a waveform explaining the driving of the microcapsule-type electrophoretic display device according to the fourth embodiment of the present invention.

FIG. 14 is a diagram showing configurations of a driving circuit of a microcapsule-type electrophoretic display device 10B according to a fourth embodiment of the present invention. FIG. 15 is a schematic circuit diagram showing configurations of a data driver 14B of the microcapsule-type electrophoretic display device 10B according to the fourth embodiment. FIG. 16 is a diagram showing change in driving the microcapsule-type electrophoretic display device 10B according to the fourth embodiment. FIG. 17 is a diagram showing a relation between an afterimage and applied voltage in the microcapsule-type electrophoretic display device 10B according to the fourth embodiment. FIG. 18 is a diagram showing waveforms explaining the driving of the microcapsule-type electrophoretic display device 10B according to the fourth embodiment.

The microcapsule-type electrophoretic display device 10B of the embodiment is so configured that frames forming a picture are divided into a plurality of minus frame groups and a plurality of plus frame groups and the number of minus frames being used for switching between display states each having the same color (same gray level) is made to coincide with the number of plus frames being used for switching between display states having the same color (same gray level) and the number of minus frames being used for switching between display states each having a different color (different gray level) is made to coincide with the number of plus frames each having a different color (different gray level), and the frame group for particles having slow mobility responsive to variation in an electric field is provided last in the display formation of the given picture. As shown in FIG. 14, the microcapsule-type electrophoretic display device 10B is so constructed that microcapsule-type electrophoretic elements 100-*mn* (m=1, 2, . . . , M; n=1, 2, . . . , N) arranged in m-rows and n-columns in a matrix form are driven by a scanning driver 12B and the data driver 14B. Configurations of the electrophoretic display panel itself are the same as those of the conventional electrophoretic display panel shown in FIG. 25. Therefore, in FIGS. 14 and 15, the same reference numbers are assigned to components having the same function as the conventional electrophoretic display panel shown in FIG. 25 and their descriptions are omitted.

Each of the microcapsule-type electrophoretic elements 100-*mn* is connected through each of a TFT gate 104-*mn* to each of a scanning line Gm and of data lines Dn. The scanning driver 12B, when being made up of a pMOS, serves as a driver to output a negative gate voltage to each of the scanning lines Gm. The data driver 14B outputs, to the data lines Dn, time-series voltages that prevent the application of a DC voltage to the microcapsule-type electrophoretic elements 100-*mn* in total frames used to rewrite a pixel for the microcapsule-type electrophoretic elements 100-*mn*.

The data driver 14B, as shown in FIG. 15, includes a selecting signal generating circuit 26B and a voltage selecting circuit 28B. The selecting signal generating circuit 26B outputs a selecting signal to make the voltage selecting circuit 28B output a time-series voltage consisting of Vwb, Vbg, Vgb=−Vbg, Vgg+, 0V, Vgg−=−Vgg+, Vwg, Vgw=−Vwg, and Vbw=−Vwb. The voltage selecting circuit 28B sends out time-series data of voltages determined according to the above selecting signal to the data line Dn. The Vwb is, for example, a voltage of +15V (to be used when display is switched from W to B). The Vbg is, for example, a voltage of +7.5V (to be used when display is switched from B to G (gray)). The Vgb=−Vbg is, for example, a voltage of −7.5V (to be used when display is switched from G to B). The Vgg+ is, for example, a voltage of +7.5V (to be used when display is switched to G). The Vgg−=−Vgg+ is, for example, a voltage of −7.5V (to be used when W is written between G and G). The Vwg is, for example, a voltage of +7.5V (to be used when display is switched from W to G). The Vgw=−Vwg is, for example, a voltage of −7.5V (to be used when display is switched from G to W). The Vbw=−Vwb is, for example, a voltage of −15V (to be used when W is written).

The selecting signal is determined depending on pixel data on each picture for an image and is switched according to pixel data on each picture. That is, each picture is formed by specified numbers of plus frame group and by specified numbers of minus frame group. For example, as shown in FIG. 18, each picture is formed by two plus frame groups and one minus frame group. The selecting signal to cause display to be switched from W to W, from B to B, and from G to G, and also from B to W, W to B, W to G, G to W, from B to G, and from G to B is generated in a manner in which following conditions are satisfied (see FIG. 16 and FIG. 18). The case where a picture is formed by the plus frame group, minus frame group, and plus frame group is described below.

When the electrophoretic elements 100-*mn* are driven in a state where W is displayed repeatedly and continuously on a given picture (in the case of continuous display of W->W->W . . . ), B is written by providing minus frame group on the picture, however, by providing plus frame group (as transition frame group) before or after the minus frame group is provided, change of display to B is made to occur in an inserted manner [see (1) of FIG. 18]. In this case, a voltage to be applied to pixel electrodes 106-*mn* of the electrophoretic elements 100-*mn* when B is written is set to be Vwb and a voltage to be applied to the pixel electrodes 106-*mn* of the electrophoretic elements 100-*mn* when W is written is set to be Vbw=−Vwb and, further, the number of white frames to be used to write W is set to be Tww− and the number of black frames to be used to write B is set to be Tww+. At this time, the setting must satisfy the following equation:

$$Tww+=Tww- \tag{5}$$

Also, when the electrophoretic elements 100-*mn* are driven in a state where black (B) is displayed repeatedly and continuously on a given picture (in the case of continuous display of B->B->B . . . ), W is written by providing plus frame group on the picture, however, by providing minus frame group (as transition frame group) before or after the plus frame group is provided, change of display to W is made to occur in an inserted manner [see (9) of FIG. 8]. In this case, a voltage to be applied to the pixel electrodes 106-*mn* of the electrophoretic elements 100-*mn* when W is written is set to be Vbw=−Vwb and a voltage to be applied to the pixel electrodes 106-*mn* of the electrophoretic elements 100-*mn* when B is written is set to be Vwb and, further, the number of minus frames to be used to write W is set to be Tbb− and the number of plus frames to be used to write B is set to be Tbb+. At this time, the setting must satisfy the following equation:

$$Tbb+=Tbb- \tag{6}$$

When the electrophoretic elements 100-*mn* are driven in a state where gray (G) is displayed repeatedly and continuously on a given picture (in the case of continuous display of G->G->G . . . ), G is written by providing a plus frame group on the picture, however, by providing a minus frame group (as a transition frame group) before or after the plus frame group is provided, change of display to W is made to occur in an inserted manner [see (4) of FIG. 8]. In this case, a voltage to be applied to the pixel electrodes 106-*mn* of the electrophoretic elements 100-*mn* when W is written is set to be Vgg− and a voltage to be applied to the pixel electrodes 106-*mn* of the electrophoretic elements 100-*mn* when G is written is set to be Vgg+ and, further, the number of minus frames to be used to write W is set to be Tgg− and the number of plus frames to be used to write B is set to be Tgg+. At this time point, the setting must satisfy the following equation:

$$Tgg+=Tgg- \tag{7}$$

Also, when display is changed from W to B on a current picture and when display is changed from B to W on a next picture, a voltage to be applied to pixel electrodes 106-*mn* of the electrophoretic elements 100-*mn* when W is written to change the display from W to B is set to be Vbw=Vwb and a voltage is applied to the pixel electrodes 106-*mn* of the electrophoretic elements 100-*mn* when B is written is set to be Vwb and the number of minus frame groups to be used to write W is set to be Twb (−) and the number of plus frame groups to be used to write B is set to be Twb (+) and, further, a voltage to be applied to the pixel electrodes 106-*mn* of the electrophoretic elements 100-*mn* when B is written to change the display from B to W is set to be Vwb and a voltage to be applied to the pixel electrodes 106-*mn* of the electrophoretic elements 100-*mn* when W is written is set to be Vbw and the number of plus frame groups to be used to write B is set to be Tbw(+) and the number of minus frame groups to be used to write W is set to be Tbw(−). At this time point, the setting must satisfy the following equation:

$$Twb(+)+Tbw(+)=Tbw(-)+Twb(-) \tag{8}$$

Also, when display is changed from W to G on a current picture and when display is changed from G to W on a next picture, a voltage to be applied to pixel electrodes 106-*mn* of the electrophoretic elements 100-*mn* when W is written to change the display from W to G is set to be Vgw and a voltage to be applied to the pixel electrodes 106-*mn* of the electrophoretic elements 100-*mn* when B is written is set to be Vwg=−Vgw and the number of minus frame groups to be used to write W is set to be Twg (−) and the number of plus frame groups to be used to write B is set to be Twg (+) and, further, a voltage to be applied to the pixel electrodes 106-*mn* of the electrophoretic elements 100-*mn* when B is written to change the display from B to W is set to be Vwg and a voltage to be applied to the pixel electrodes 106-*mn* of the electrophoretic elements 100-*mn* when W is written is set to be Vgw and the number of plus frame groups to be used to write B is set to be Tgw(+) and the number of minus frame groups to be used to write W is set to be Tgw(−). At this time point, the setting must satisfy the following equation:

$$Twg(+)+Tgw(+)=Tgw(-)+Twg(-) \tag{9}$$

Also, when display is changed from B to G on a current picture and when display is changed from G to B on a next picture, a voltage to be applied to pixel electrodes 106-*mn* of the electrophoretic elements 100-*mn* when B is written to change the display from B to G is set to be Vgw and a voltage to be applied to the pixel electrodes 106-*mn* of the electrophoretic elements 100-*mn* when B is written is set to be Vbg=−Vgb and the number of minus frame groups to be used to write W is set to be Tbg (−) and the number of plus frame groups to be used to write G is set to be Tbg (+) and, further, a voltage to be applied to the pixel electrodes 106-*mn* of the electrophoretic elements 100-*mn* when B is written to change the display from G to B is set to be Vbg and a voltage to be applied to the pixel electrodes 106-*mn* of the electrophoretic elements 100-*mn* when B is written is set to be Vgb and the number of plus frame groups to be used to write B is set to be Tgb(+) and the number of minus frame groups to be used to write W is set to be Tgb(−). At this time point, the setting must satisfy the following equation:

$$Tbg(+)+Tgb(+)=Tgb(-)+Tbg(-) \quad (10)$$

However, in the case when display is switched from W to G and from G to W, and from B to G and from G to B, though voltages are set so as to be Vgw(+)=−Vgw (+) and to be Vgb (−)=−Vbg (+), it is not necessary that an absolute value of the voltage of Vgw is equal to that of the voltage of Vgb and that an absolute value of the voltage of the Vgg+ is equal to that of the voltage of the Vgg−. The reason for that is that, in the change state shown in FIG. 17, the charged amount of the white particles and the black particles are not equal to each other and the mobility of the white particles and the black particles are not equal to each other and, therefore, as shown in the left portion of FIG. 17, if the voltages are made to be equal in both the white and black states, an afterimage is produced. This holds true for the case where display is switched from G to G.

Next, by referring to FIGS. 4, 6, 7, and FIGS. 14 to 18, operations of the electrophoretic display device of the fourth embodiment are described below. In the driving the microcapsule-type electrophoretic display device 10B of the fourth embodiment, the driving method of making the electrophoretic elements 100-*mn* switch display from W to B or from B to W is the same as those employed in the conventional display device except for the following points. That is, any picture that displays images is formed by providing a plurality of plus frame groups and a plurality of minus frame groups is displayed in specified time-series order. For example, as shown in FIG. 18, in every picture, one plus frame group, one minus frame group, and one plus frame group are arranged in this order.

Operations of switching a picture from a given picture to a second picture, a third picture, and a fourth picture by sequentially switching display of the picture from B->W->B->W are described below. At a start point of a period corresponding to a specified number [Twb(+)] of plus frame making up the front portion of the second plus frame group for the first picture, a signal to turn ON the TFT gate 104-*mn* is sent out from the scanning driver 12B to the gate line Gm and a voltage of Vwb, for example, a voltage of +15V is applied to the pixel electrodes 106-*mn* of the electrophoretic elements 100-*mn* to write B to the electrophoretic elements 100-*mn* to make the electrophoretic elements 100-*mn* display black and at a start point in the period corresponding to a specified number [number of frames being Twb(+)] of plus frames making up the rear portion of the second plus frame group, a voltage of 0V is applied to the pixel electrodes 106-*mn* of the electrophoretic elements 100-*mn* to keep the displayed state [see (5) of FIG. 18] and, then at a start point in the period corresponding to minus frame group [number of frames being Tbw(−)] for the second picture, a signal to turn ON the TFT gate 104-Gm is sent out from the scanning driver 12B to the gate line Gm and a voltage Vbw, for example, −15V is applied to the pixel electrodes 106-*mn* of the electro-phoretic elements 100-*mn* from the data lines Dn of the data driver 14B to make the electrophoretic elements 100-*mn* switch the display to W.

Next, application of a voltage of 0V and a voltage of Vbw to the pixel electrodes 106-*mn* of the electrophoretic elements 100-*mn* is described by referring to FIG. 15. That is, the selecting signal generating circuit 26B that receives picture data outputs a negative voltage on a selecting line 38-*n* at a start point in the period corresponding to the specified number of plus frames out of the second plus frame group on the first picture to make the electrophoretic elements 100-*mn* switch the display to W. This causes a p-MOS, for example, pMOS 48-*n* making up the voltage selecting circuit 28B to be turned ON and a voltage of 0V is output to the data line Dn. Then, a negative voltage is output on a selecting line corresponding to the above pixel, for example, a selecting line 31-*n* during the period corresponding to the minus frame group for the second picture. This causes a p-MOS, for example, pMOS 41-*n* making up the voltage selecting circuit 28B to be turned ON and a voltage of Vbw is output to the data lines Dn.

Thus, by applying a voltage of Vbw, for example, a voltage of −15V to the pixel electrodes 106-*mn* of the electrophoretic elements 100-*mn*, positively-charged carbon particles in black are attracted toward the pixel electrodes 106-*mn* and negatively-charged titanium oxide particles in white are driven out toward a counter electrode 122. As a result, the electrophoretic elements 100-*mn* switch the display from B to W [see (5) of FIG. 18].

Then, when the electrophoretic elements 100-*mn* are made to switch the display from W to B on the next picture (third picture) subsequent to the picture on which W is being displayed after being switched (on the second picture described above), a signal to turn ON the TFT gate 104-*mn* is sent out to the gate line Gm from the scanning driver 12B and a voltage of Vwb, for example, a voltage of +15V is applied from the data line Dn of the data driver 14B to the pixel electrodes 106-*mn*.

The application of a voltage of Vwb to the pixel electrodes 106-*mn* of the electrophoretic elements 100-*mn* is described by referring to FIG. 15. The selecting signal generating circuit 26B, when display is to be switched from W being displayed by the electrophoretic elements 100-*mn* to B at a start point in the period corresponding to a specified number of frames [number of frames being Twb(+)] making up a front portion of the second plus frame group for the third picture, outputs a negative voltage on a selecting line corresponding to the above pixel, for example, a selecting line 30-*n*. This causes a pMOS 40-*n* making up the voltage selecting circuit 28B to be turned ON and a voltage of Vwb is output at the time in the period corresponding to the specified number of frames making up the front portion of the second plus frame group for the second picture. Then, a negative voltage is output from the selecting signal generating circuit 26B on the selecting line 38-*n* during the period corresponding to frames following the specified number of frames making up the front portion of the second plus frame group.

Thus, by applying the voltage of Vwb, for example, a voltage of +15V to the pixel electrodes 106-*mn* of the electrophoretic elements 100-*mn*, negatively-charged titanium oxide particles in white are attracted toward the pixel electrodes 106-*mn* and positively-charged carbon particles in black are driven out toward the counter electrode 122. As a result, the electrophoretic elements 100-*mn* switch the display from W to B [see (6) of FIG. 18].

Then, when the electrophoretic elements 100-*mn* are made to switch the display from B to w on the next picture (fourth picture) subsequent to the picture on which B is being displayed after being switched (on the third picture described above), a signal to turn ON the TFT gate 104-*mn* is sent out to the gate line Gm from the scanning driver 12B and the voltage of Vbw, for example, a voltage of −15V is applied from the data line Dn of the data driver 14B to the pixel electrodes 106-*mn*.

The application of the voltage of Vbw to the pixel electrodes 106-*mn* of the electrophoretic elements 100-*mn* is described by referring to FIG. 15. The selecting signal generating circuit 26B that receives picture data, when the display is switched from B being displayed by the electrophoretic elements 100-*mn* to W by providing minus frame groups [number of frames being Tbw(−)] for the fourth picture, outputs a negative voltage on a selecting line corresponding to the above pixel, for example, on the selecting line 31-*n* during the period corresponding to the minus frame groups. This causes a p-MOS 41-*n* making up the voltage selecting circuit 28B to be turned ON and a voltage of Vbw is output to the data line Dn.

Thus, by applying the voltage of Vbw, for example, a voltage of −15V to the pixel electrodes 106-*mn* of the electrophoretic elements 100-*mn*, positively-charged carbon particles in black are attracted toward the pixel electrodes 106-*mn* and negatively-charged titanium oxide in white are driven out toward the counter electrode 122. As a result, the electrophoretic elements 100-*mn* switch the display from B to W [see (5) of FIG. 18].

As described above, when the electrophoretic elements 100-*mn* repeatedly switch the display from W to B and from B to W on every picture, the number of black frames for B display and the number of white frames for W display are set so as to satisfy the equation (7) described above. Owing to this, a DC voltage is not applied to the electrophoretic elements 100-*mn*, thus preventing the occurrence of the burn-in problem.

The same problems as above arise when the display is switched from G to W and then from W to G, or from G to B, and then from B to G. However, the described method, shown in FIG. 16 by showing a change diagram, of solving the problem of the image burn-in occurring when the display is switched from W to B and then from B to W can be applied well to the case where the display is switched from G to W and then from W to G, or from G to B and then from B to G and their detailed descriptions are omitted here accordingly.

For reference purposes, additional descriptions to be used for applying the method shown in FIG. 16 are provided. That is, the Vbw and Vwb applied when the display is switched from B to W and then from W to B should read, instead, the Vgw and Vwg respectively when the display is switched from W to G and should read, instead, the Vgb and Vbg when the display is switched from G to B and then from B to G. In addition, the Twb (+), Twb (−), Tbw (+), and Tbw(−) used when the display is switched from B to W and then from W to B should read, instead, Twg(+), Twg(−), Tgw (+), and Tgw (−) respectively when the display is switched from G to W and the W to G and should read, instead, Tgb(+), Tbg (−), Tbg (+), and Tbg (−) when the display is switched from G to B and then from B to G.

Moreover, in FIG. 15, the selecting lines 30-*n* and 31-*n* used when the display is switched from W to B and then from B to W should read, instead, the selecting lines 32-*n* and 33-*n* respectively when the display is switched from W to G and then from G to W and should read, instead, the selecting line 34-*n* and 35-*n* when the display is switched from G to B and then from B to G. The pMOSs 42-*n* and 43-*n* used when the display is switched from B to W and then from W to B should read, instead, the pMOSs 42-*n* and 43-*n*, respectively, when the display is switched from G to W and then from W to G and should read, instead, the pMOSs 44-*n* and 45-*n* when the display is switched from G to B and then from B to G.

The driving methods of making the electrophoretic elements 100-*mn* switch the display from W to W and of making the electrophoretic elements 100-*mn* switch the display from B to B are as follows: When the electrophoretic elements 100-*mn* are made to switch the display from W to W, as shown in (1) of FIG. 18, if W is displayed on every picture, B is written by providing the first plus frame group before minus frame group for the picture is provided. The number of frames Tww+ making up the first plus frame group to be provided as above is set to be equal to the number of frames Tww− making up the first minus frame group to be provided following the first plus frame group. In this case, when B is written by providing the first plus frame group and when W is written by providing the minus frame group, a voltage is applied to the pixel electrode 106-*mn* of the electrophoretic elements 100-*mn*. The method of applying the voltage is the same as the described case in which the display is switched to a different color (gray-level) and their detailed descriptions are omitted accordingly.

Also, when the electrophoretic elements 100-*mn* are made to switch the display from B to B, if B is displayed on every picture, as shown in (9) of FIG. 18, W is written by providing the minus frame group on the picture. The number of frames Tbb+ to be provided as above is set to be equal to the number of frames Tbb− making up the first minus frame group to be provided. The method of applying a voltage to the pixel electrode 106-*mn* when W is written by providing the plus frame group and when W is written by providing the minus frame group is the same as in the case when the display is switched from W to W.

Also, when the electrophoretic elements 100-*mn* are made to switch the display from G to G, as shown in (4) in FIG. 18, if G is displayed on every picture, W is written by providing the minus frame group on the picture. The number of frames Tgg+ to be provided as above is set to be equal to the number of frames Tgg− making up the first minus frame group to be provided after the first plus frame group is provided. In this case, when G is written by providing the first plus frame group and when G is written by providing the minus frame group, a voltage is applied to the pixel electrode 106-*mn* of the electrophoretic elements 100-*mn*. The method of applying the voltage is the same as the described case in which the display is switched from W to W.

The result from an experiment made by the inventor has confirmed that, according to the driving method of the embodiment, as shown in FIG. 18, when the electrophoretic elements 100-*mn* switch their display states from W to W, by inserting the B display between W display and W display, it is made possible to prevent charge-up in the electrophoretic elements 100-*mn* and occurrence of an image burn-in and, additionally, since a picture is displayed by the application of a negative voltage (voltage for white), a decrease in white luminance (first afterimage described above) can be prevented more than when compared with the case where a white state is maintained by memory characteristic of the microcapsule-type electrophoretic element. Moreover, when the display is switched from B to B, by inserting W display between the B and B display, an increase in black luminance (first afterimage described above) can be prevented more than when compared with the case where a black state is maintained by memory characteristic of the microcapsule-type electrophoretic element. Moreover, when the display is switched from G to G, by inserting W display between the G and G display, same effects as obtained by inserting W display were experimentally confirmed.

The described problem of the second afterimage occurs due to the reason that, in the case where the pixel electrode is a small and fine pattern with the size of 100 μm to 150 μm, particles contained in the microcapsule making up the electrophoretic element are affected by a leakage electric field generated by a pixel voltage in the neighboring electrophoretic element. The problem occurs even if no voltage is applied to the pixel electrode of the electrophoretic element or a voltage is applied, so long as there is leakage electric field from the electrophoretic element adjacent to the current electrophoretic element.

The occurrence of the second afterimage depends on a difference in charged amounts of different particles contained in the microcapsule. It is difficult to make charged amounts of white particles in the microcapsule be equal to charge amounts of black particles in the microcapsule. The inventor's evaluation of electrophoretic display devices shows that, since charged amounts of TiO particles being white particles are larger than that of carbon particles being black particles, the white particles move earlier than the black particles. Therefore, if the microcapsules are interposed between the pixel electrodes, a surface of the microcapsule becomes white and white particles invade a neighboring pixel (see FIG. 6) which the black display region is damaged.

To solve this problem, the driving method is employed in which white frames to be written on a given picture are separated from black frames to be written and frames having less charged amounts of particles, less mobility of particles, or a like, that is, black frames, which are selected based on the inventor's evaluation, are written last in the formation of the given picture. By employing this driving method, though white particles invade a neighboring pixel once, black is written next and, therefore, black particles and white particles can be separated from one another in a microcapsule on a border among pixels in terms of regional separation (see FIG. 7) and the second afterimage problem can be solved. The reason why the black particles did not invade the neighboring pixel electrode is though to be that a charged amount, mobility, or a like of the black particles is smaller than those of white particles and that the number of writing frames is optimized.

It is demonstrated that the driving methods described above serve to solve the first and second afterimage problems, the image burn-in problem described in the chapter of the "Description of the Related Art". To describe the above driving method briefly, frames to be written into the electrophoretic elements are separated from one another and frames having less charged amounts of particles are written last in the formation of a given picture. When the display is switched from W to W, B is written by providing a black frame (as a transition frame) being displayed before or after W to be written by providing a white frame on a picture in a manner in which the equation (5) described above is satisfied. Also, when the display is switched from B to B, W is written by providing a white frame (as a transition frame) existing before or after B to be written by providing a black frame on a picture in a manner in which the equation (6) described above is satisfied. Further, when the display is switched from W to B on a current picture and when the display is switched from B to W on a next picture, writing is performed in a manner in which the equation (7) described above is satisfied.

Also, when the display is switched from W to B on a current picture and the display is switched from B to W on a next picture, the driving operation is performed in a manner to satisfy the above equation (8). When the display is switched from w to G on a current picture and display is switched from G to W on a next picture, the driving operation is performed in a manner to satisfy the above equation (9). When the display is switched from B to G on a current picture and the display is switched from G to B on a next picture, the driving operation is performed in a manner to satisfy the above equation (10).

Thus, according to the fourth embodiment, provision of the one minus frame group is inserted between two provisions of plus frame groups when a picture is formed and when the display is switched from W to W repeatedly and continuously, B is written before W is written, and the driving operation is performed so that the number of frames for W and the number of frames for B are set to satisfy the above equation (5) and, therefore, the first afterimage and the image burn-in that would occur in the continuous switching for W can be avoided. Moreover, when the display is switched from B to B repeatedly and continuously, W is written after B is written in a manner in which the number of B and W frames satisfy the above equation (6) and, therefore, the employed driving method serves to solve the first afterimage and the image burn-in problems caused by the continuous switching of B. Furthermore, when the display is switched from G to G repeatedly and continuously, W is written after G is written in a manner in which the number of G and W frames satisfy the above equation (7) and, therefore, the employed driving method serves to solve the first afterimage and the image burn-in problems caused by the continuous switching of G.

Besides, when display is switched among different colors (gray levels), that is, among W, B, and G repeatedly and continuously, the driving operation is performed so that the number of frames to be written satisfy the above equations (8), (9), and (10), the problems caused by continuous switching of display among different colors can be solved. Additionally, by writing the black frame group last in the formation of a picture, the second afterimage can be avoided.

Fifth Embodiment

Figure 19:
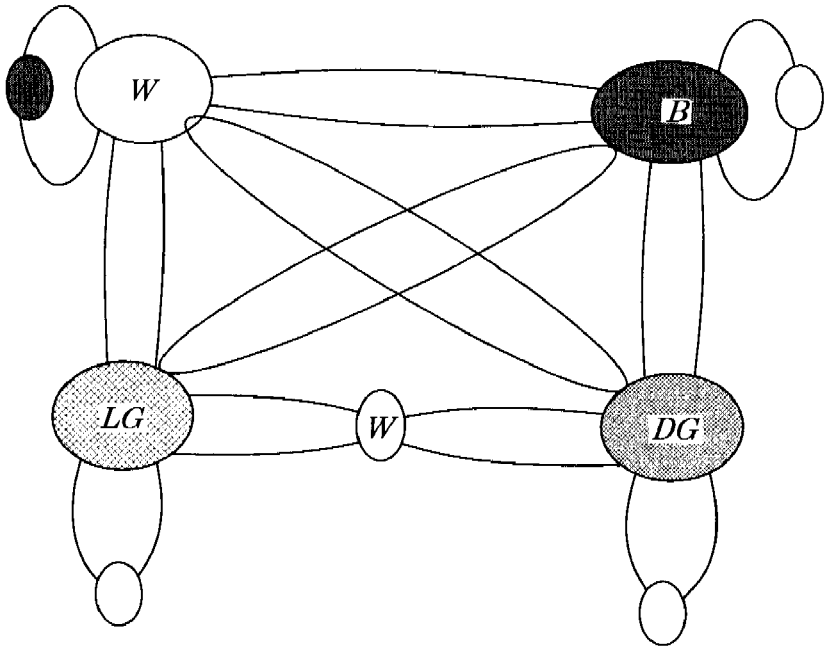
FIG. 19 is a diagram showing changes in display state in driving a microcapsule-type electrophoretic display device according to a fifth embodiment of the present invention.
Figure 20:
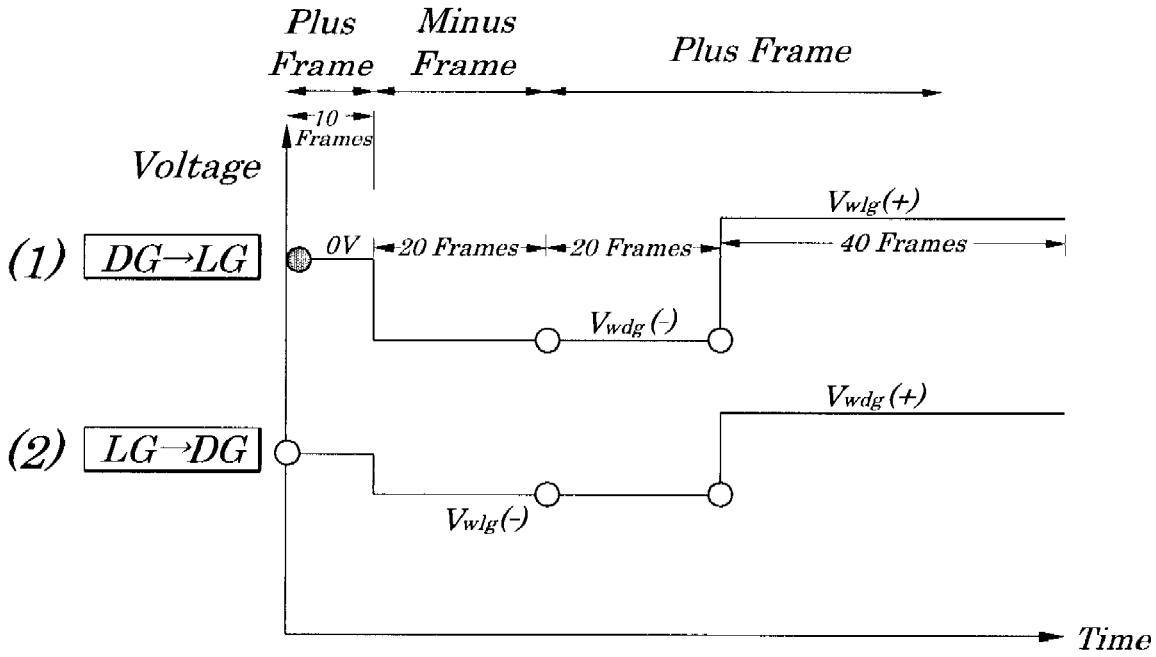
FIG. 20 is a time chart explaining driving of the microcapsule-type electrophoretic display device of the fifth embodiment of the present invention.

FIG. 19 is a diagram showing changes in display state in driving an electrophoretic display device according to the fifth embodiment of the present invention. FIG. 20 is a time chart explaining a driving method of the microcapsule-type electrophoretic display device of the fifth embodiment. The method of driving of the fifth embodiment differs greatly from that employed in the fourth embodiment in that the microcapsule-type electrophoretic display device is driven in four gray levels instead of three gray levels. That is, in the microcapsule-type electrophoretic display device (not shown in FIG. 19), a half-tone, gray (G), employed in the fourth embodiment includes light gray (LG) and dark gray (DG) and the same driving method as performed in the fourth embodiment in switching of display among W, B, and LG and among W, B, and DG and the driving method to be performed for display switching between LG and DG is as follows.

That is, when a display is switched between LG and DG, as shown in FIG. 19, the display is made to switch to W once. After the display has been switched once from LG to W and then to DG, then the display is made to be switched from DG to W and then to LG to avoid difficulty in calibration of voltages. This allows use of a driving waveform and voltage to be used in the same way as in the case where display is switched from LG to W and from W to DG.

In the display switching from DG to LG and from LG to DG, when the display is switched from DG to LG and then to DG, W is written between LG and DG to achieve the switching from DG to W and then to LG and from LG to W and then to DG. In this case, in order to switch the display from DG to W, a voltage to be applied to pixel electrodes 106-*mn* of electrophoretic elements 100-*mn* is set to be Vw+dg(+), for example, +1.2V and the number of frames provided at this voltage is set to be Tw−dg(+). In order to switch the display from W to LG, a voltage to be applied to pixel electrodes 106-*mn* of the electrophoretic elements 100-*mn* is set to be Vw−lg(−), for example, −5V and the number of frames provided at this voltage is set to be Tw−lg(−). Also, in order to switch the display from LG to W, a voltage to be applied to pixel electrodes 106-*mn* of the electrophoretic elements 100-*mn* is set to be Vw−lg(+), for example, +5V and the number of frames provided at this voltage is set to be Tw−lg(+). Moreover, in order to switch the display from W to DG, a voltage to be applied to the pixel electrodes 106-*mn* of the electrophoretic elements 100-*mn* is set to be Vw−dg−), for example, −12V and the number of frames provided at this voltage is set to be Tw−lg(−).

When the voltage and the number of frames to be used when display is switched from DG->LG->DG are expressed as described, calibration is performed so that the following equations hold:

$$Vw-dg(-)=-Vw-dg(+), Vw-lg(-)=-Vw-lg(+) \quad (11)$$

$$Tw-dg(+)=Tw-dg(-), Tw-lg(+)=Tw-lg(-) \quad (12)$$

Further calibration is performed so that absolute values of voltages Vw−dg and Vw−lg do not cause an afterimage, and images are displayed in a specified gray levels to drive the electrophoretic display device.

Next, operations of the electrophoretic display device of the fifth embodiment are explained by referring to FIGS. 19 and 20. In the embodiment, images are displayed in four gray levels, that is, in W, B, LG, and DG. The driving method for displaying images in three gray levels, that is, in W, B, and LG and in three levels, that is, in W, B, and DG when images are displayed in four gray levels is the same as described in the fourth embodiment. Therefore, the driving method for switching the display between LG and DG in four gray levels is described below.

When driving is performed to as to switch the display from LG to DG and from DG to LG, writing of W is inserted between writing of LG and DG so that the display is switched from DG->W->LG and from LG->W->DG. When driving is performed so as to switch the display from DG to LG, in order to switch the display from DG to W, a voltage of Vw−dg(+) is applied to the pixel electrode of the electrophoretic elements 100-*mn* during a period corresponding to the number of frames Tw−dg(+). Then, in order to switch the display from W to LG, a voltage of Vw−lg(−) is applied to the pixel electrode of the electrophoretic elements 100-*mn* during a period corresponding to the number of frames Tw−lg(−). By the application, switching of display from DG to LG occurs.

Also, when driving is performed so as to switch display from LG to DG, in order to switch the display from LG to W, a voltage of Vw−dg(+) is applied to the pixel electrode of the electrophoretic elements 100-*mn* during a period corresponding to the number of frames Tw−dg(+). Then, in order to switch the display from W to DG, a voltage of Vw−dg(−) is applied to the pixel electrode of the electrophoretic elements 100-*mn* during a period corresponding to the number of frames Tw-dg(−). By the application, switching of the display from LG to DG occurs.

When the display is switched from DG->LG->DG, calibration is performed so that the voltage and the number of frames satisfy the above equations (11) and (12) and so that the absolute value of voltages Vw−dg and Vw−lg do not cause an afterimage on a picture and images are displayed in a specified gray level. A concrete example of the driving described above is shown in FIG. 20. The number (1) in FIG. 20 shows waveforms for driving to switch the display from DG to LG and (2) shows waveforms for driving to switch display from LG to DG.

Thus, according to the fifth embodiment, the driving method employed in the fourth embodiment is applied to the case where the display is switched among W, B, and LG and among W, B. DG and the driving to switch the display between DG and LG is performed in a manner in which the above equations (11) and (12) are satisfied and in which the absolute values of voltages Vw−dg and Vw−lg do not cause an afterimage and so that images are displayed in four gray of levels and, therefore, even when images are displayed in four gray of levels, problems of afterimages and burn-in on a picture can be solved.

Sixth Embodiment

Figure 21:
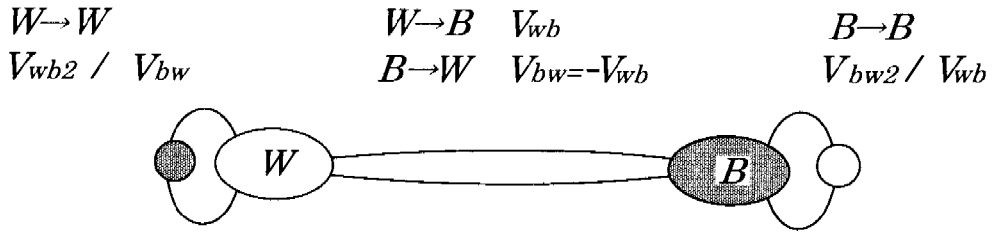
FIG. 21 is a diagram showing changes in driving a microcapsule-type electrophoretic display device according to a sixth embodiment of the present invention.
Figure 22:
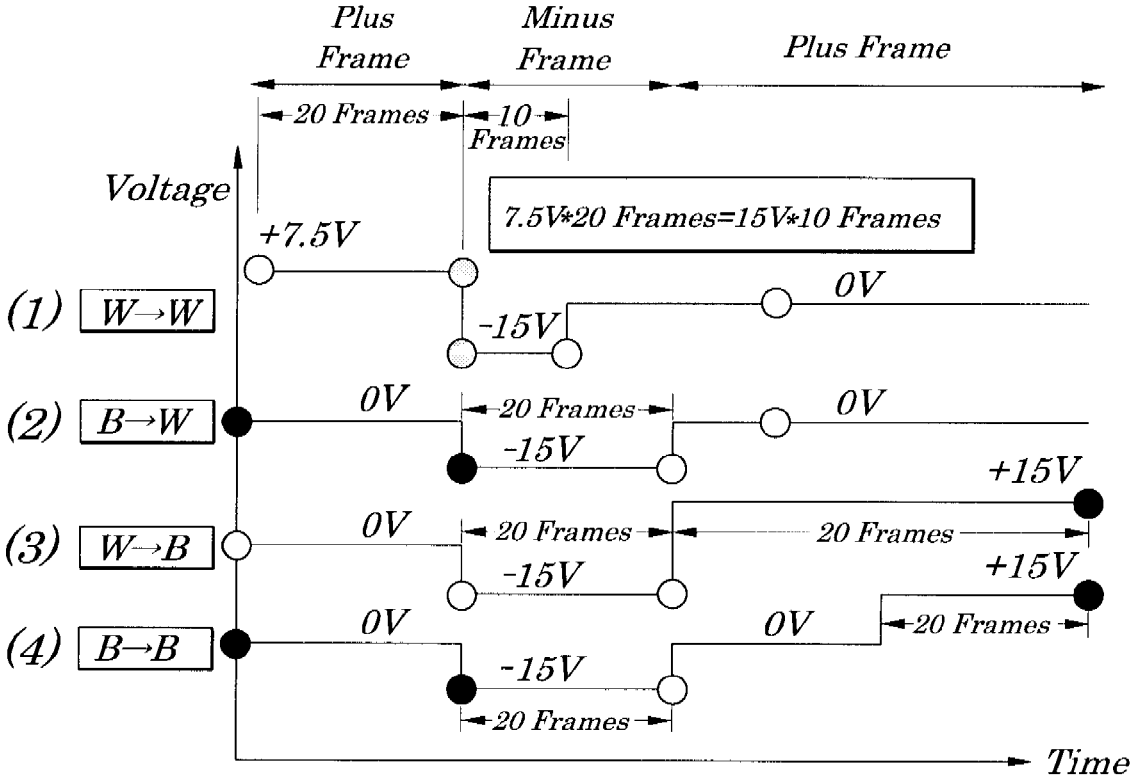
FIG. 22 is a diagram showing a waveform explaining the driving of the microcapsule-type electrophoretic display device according to the sixth embodiment of the present invention.
Figure 23:
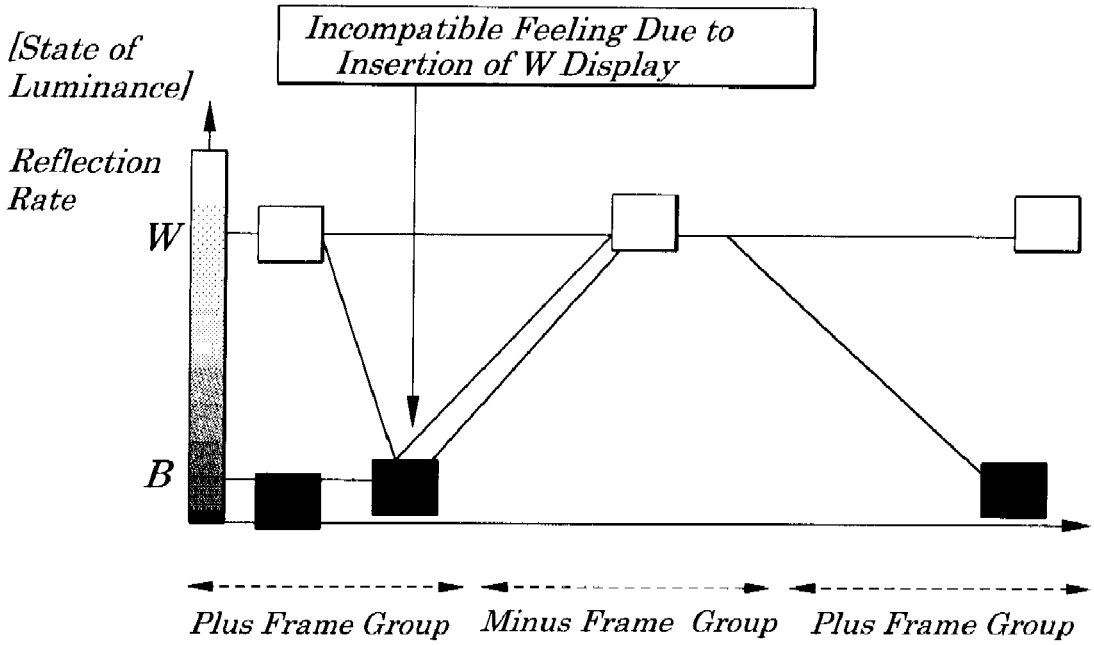
FIG. 23 is a time chart explaining disadvantages in the fourth and fifth embodiments.
Figure 24:
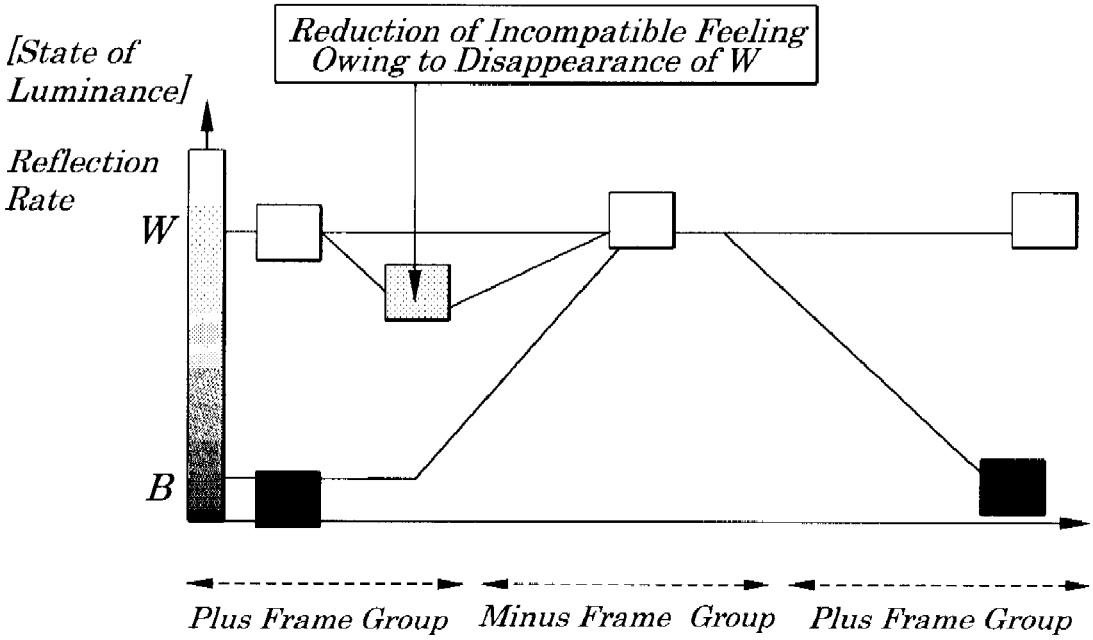
FIG. 24 is a time chart explaining advantages in the sixth embodiment of the present invention.

FIG. 21 is a diagram showing changes in driving a microcapsule-type electrophoretic display device according to a sixth embodiment of the present invention. FIG. 22 is a diagram showing a waveform explaining the driving of the microcapsule-type electrophoretic display device according to the sixth embodiment. FIG. 23 is a timing chart explaining disadvantages in the fourth and fifth embodiments. FIG. 24 is a timing chart explaining advantages in the sixth embodiment. Configurations of the microcapsule-type electrophoretic display device of the sixth embodiment differ greatly from those of the fourth and fifth embodiments in that a flickered display state occurring when a picture is switched in the fifth embodiment is prevented.

That is, in the electrophoretic display device of the sixth embodiment, when a display is switched from W->B->W, a voltage used to provide a plus frame group when the display is switched from W to B is not set to be +V (Vwb), for example, +15V, as shown in FIGS. 21 and 22, but a voltage of −15V is applied which has been produced after an intermediate potential (Vwb2) to make the electrophoretic elements display light gray (LG), for example, +7.5V is applied and when display is switched from B->W->B, a voltage used to provide a minus frame group when the display is switched from B to W is not set to be −V (Vwb), for example, −15V, but a voltage of +15V is applied which has been produced after an intermediate potential (Vbw2) to make the electrophoretic elements display dark gray (DG), for example, a voltage of +12V has been applied. Also, when the display is switched from G->W->G, a voltage used when the display is switched to W is not applied but a voltage produced after an intermediate potential was applied is applied. However, to simplify the description, the display switching from G->W->G is not shown in FIGS. 21 and 22.

Additionally, in any one of the display switching cases described above, the number of frames T1 provided when the intermediate potential of Vwb2 is applied and the number of frames T2 provided when the intermediate potential of Vbw2 is applied must be set so as to satisfy the following equation:

$$Vwb2\times T1=Vbw2\times T2 \quad (13)$$

This enables suppression of an occurrence (charge-up) of a DC potential in an electrophoretic film. By satisfying the above equation (13), the charge-up can be suppressed, however, even if the above equation (13) is satisfied, the problem of movement of black particles in a microcapsule cannot be solved, that is, an amount of movement of black particles is not the same in the microcapsule. This is because, if a voltage is low, an amount of movement of black particles is small.

In the fourth and fifth embodiments, as shown in FIG. 23, when display is switched from W->B->W, flashing, that is, flickering glare (incompatible feeling) occurs in the display of W, B, and then W. However, by driving the electrophoretic display device according to the method employed in the six embodiment, as shown in FIG. 24, LG is displayed after W is displayed and then the W is displayed and, therefore, it is possible to greatly reduce incompatible feeling occurring in the display. Also, in the fourth and fifth embodiments, when the display is switched from B->W->B, flashing, that is, flickering glare (incompatible feeling) occurs in the display of black, white, and then black. However, by driving the electrophoretic display device according to the method employed in the six embodiment, as shown in FIG. 24, DG is displayed after B is displayed and then the B is displayed and, therefore, it is possible to greatly reduce incompatible feeling occurring in the display. Thus, according to the six embodiment, not only the same effects as obtained in the fourth and fifth embodiments but also reduction in flashing can be achieved.

It is apparent that the present invention is not limited to the above embodiments but may be changed and modified without departing from the scope and spirit of the invention. For example, in each of the above embodiments, when the display is switched from W->W->W on one picture, it is necessary to satisfy the equations (1) and (5) and when the display is switched from B->B->B on one picture, it is necessary to satisfy the equations (2) and (6), and when the display is switched from G->G->G on one picture, it is necessary to satisfy the equation (7), to meet these conditions are not necessarily required and some discrepancy is allowed. Similarly, when the display is switched from W->B->B->W between pictures, it is necessary to satisfy the equations (3) and (13), to meet these conditions are not necessarily required and some discrepancy is allowed. Similarly, when the display is switched from W->B->B->B between pictures, it is necessary to satisfy the equations (3) and (8) and when the display is switched from W->G->G->W between pictures, it is necessary to satisfy the equation (9), and when the display is switched from B->G->G->B between pictures, it is necessary to satisfy the equation (10), to meet these conditions are not necessarily required and some discrepancy is allowed. Moreover, when the display is switched from DG->LG->DG between pictures, it is necessary to satisfy the equations (11) and (12), to meet these conditions are not necessarily required and some discrepancy is allowed. Irrespective of whether the above equations are satisfied or not, by appropriately selecting a potential difference based on a material for charged particles or a half tone to be displayed, the present invention can be carried out. In the above embodiments, white charged particles and black charged particles sealed in the microcapsule of the electrophoretic display device are used, however, the present invention can be carried out by using charged particles each having color other than white or black. In this case, a potential difference to be applied between a pixel electrode of the microcapsule-type electrophoretic element and a counter electrode varies depending on particles sealed in the microcapsule. It is natural that a potential difference to be applied to display a half tone color between two colors varies as well. Moreover, in the above embodiments, in a PET facing substrate, one piece of a counter electrode is stuck to a transparent plastic substrate, however, the present invention can be carried out by configuring the PET facing substrate with facing substrates arranged in every scanning direction.

Besides, the method of driving the microcapsule-type electrophoretic display device can be applied to various display devices, for example, an information processing device, personal digital assistant (PDA), video camera, or a like.

What is claimed is:

1. An electrophoretic display device comprising:

a pixel substrate including a plurality of signal lines, a plurality of scanning lines, said signal lines and scanning lines intersecting each other, and a plurality of pixel electrodes as electrophoretic elements disposed at intersections of said signal lines and said scanning lines;

a facing substrate including a transparent counter electrode to face said plurality of pixel electrodes and making up a display surface;

an electrophoretic film sandwiched between said pixel substrate and said facing substrate and including first colored charged particles with a first color and a first polarity and second colored charged particles with a second color and a second polarity, said second color and said second polarity being different from said first color and said first polarity; and a voltage selection unit for selecting a time-series voltage in response to input display data for each pixel electrode and applying the selected time-series voltage between said each pixel electrode and said transparent counter electrode, during a period of time corresponding to a specified number of frames comprising at least first frames or second frames which are selectively provided based on said input display data for each pixel electrode, wherein, during a period of time corresponding to each first frame, said voltage selection unit applies a first voltage between an appropriate one of said plurality of the pixel electrodes and said transparent counter electrode to move said first colored charged particles toward a side of said display surface and to move said second colored charged particles away from said side of said display surface, wherein, during a period of time corresponding to each second frame, said voltage selection unit applies a second voltage between an appropriate one of said plurality of the pixel electrodes and said transparent counter electrode to move said second colored charged particles toward a side of said display surface and to move said first colored charged particles away from said side of said display surface, and wherein said voltage selection unit provides said first and/or second frames, respectively, during a period of a first transition state changing from a current picture whose display state is brought by said first colored charged particles to a next picture whose display state is brought by said second colored charged particles, and during a period of a second transition state changing from a current picture whose display state is brought by said second colored charged particles to a next picture whose display state is brought by said first colored charged particles, for each appropriate pixel electrode, on condition of satisfying a following equation:

$$Twb(+)+Tbw(+)=Tbw(-)+Twb(-),$$

where Twb(−) denotes a number of said first frames which are provided during the period of the first transition state, and Twb(+) denotes a number of said second frames which are provided during the period of the first transition state, Twb(−) being not equal to Twb(+); and Tbw(−) denotes a number of said first frames which are provided during the period of the second transition state, and Tbw(+) denotes a number of said second frames which are provided during the period of the second transition state, Tbw(−) being not equal to Tbw(+).

2. The electrophoretic display device according to claim 1, wherein said voltage selection unit provides said first and second frames, respectively, during a period of a third transition state changing from a current picture whose display state is brought by said first colored charged particles to a next picture whose display state is brought by said first colored charged particles, and during a period of a fourth transition state changing from a current picture whose display state is brought by said second colored charged particles to a next picture whose display state is brought by said second colored charged particles, for each appropriate pixel electrode, on condition of satisfying a following equation:

$$Tww(+)=Tww(-), \text{ and}$$

$$Tbb(+)=Tbb(-),$$

where Tww(−) denotes a number of said first frames which are provided during the period of the third transition state, and Tww(+) denotes a number of said second frames which are provided during the period of the third transition state, and Tbb(+) denotes a number of said second frames which are provided during the period of the fourth transition state, and Tbb(−) denotes a number of said first frames which are provided during the period of the fourth transition state.

3. The electrophoretic display device according to claim 2, wherein said Tww(+) is set to be not equal to said Tbb(+).

4. An electrophoretic display device comprising:

a pixel substrate including a plurality of signal lines, a plurality of scanning lines, said signal lines and scanning lines intersecting each other, and a plurality of pixel electrodes as electrophoretic elements disposed at intersections of said signal lines and said scanning lines;

a facing substrate including a transparent counter electrode to face said plurality of pixel electrodes and making up a display surface;

an electrophoretic film sandwiched between said pixel substrate and said facing substrate and including first colored charged particles with a first color and a first polarity and second colored charged particles with a second color and a second polarity, said second color and said second polarity being different from said first color and said first polarity; and a voltage selection unit for selecting a time-series voltage in response to input display data for each pixel electrode and applying the selected time-series voltage between said each pixel electrode and said transparent counter electrode, during a period of time corresponding to a specified number of frames comprising at least first or second frames or halftone frames which are selectively provided based on said input display data for each pixel electrode, wherein, during a period of time corresponding to each first or second frame, said voltage selection unit applies a first or second voltage between each appropriate one of said plurality of the pixel electrodes and said transparent counter electrode to move said first or second colored charged particles toward a side of said display surface and to move said second or first colored charged particles away from said side of said display surface, wherein, during a period of time corresponding to each halftone frame, said voltage selection unit applies an intermediate voltage between each appropriate one of said plurality of the pixel electrodes and said transparent counter electrode, said intermediate voltage set between said first voltage and second voltage, and wherein said voltage selection unit provides said first or second frames and/or halftone frames, respectively, during a period of first transition state changing from a current picture whose display state is brought by said first or second colored charged particles to a next picture whose display state is a halftone, and during a period of a second transition state changing from a current picture whose display state is a halftone to a next picture whose display state is brought by said first or second colored charged particles, for each appropriate pixel electrode, on condition of satisfying a following equation:

$$Twg(+)+Tgw(+)=Twg(-)+Tgw(-),$$

where Twg(−) denotes a number of said first or second frames which are provided during the period of the first transition state, and Twg(+) denotes a number of said halftone frames which are provided during the period of the first transition state, Twg(−) being not equal to Twg (+); and Tgw(−) denotes a number of said first or second frames which are provided during the period of the second transition state, and Tgw(+) denotes a number of said halftone frames which are provided during the period of the second transition state, Tgw(−) being not equal to Tgw(+).

5. A method of driving an electrophoretic display device which includes a pixel substrate including a plurality of signal lines, a plurality of scanning lines, said signal lines and scanning lines intersecting each other, and a plurality of pixel electrodes as electrophoretic elements disposed at intersections of said signal lines and said scanning lines, a facing substrate including a transparent counter electrode to face said plurality of pixel electrodes and making up a display surface, and an electrophoretic film sandwiched between said pixel substrate and said facing substrate and including first colored charged particles with a first color and a first polarity and second colored charged particles with a second color and a second polarity, said second color and said second polarity being different from said first color and said first polarity, the method comprising:

selecting a time-series voltage in response to input display data for each pixel electrode, and applying the selected time-series voltage between said each pixel electrode and said transparent counter electrode, during a period of time corresponding to a specified number of frames comprising at least first frames or second frames which are selectively provided based on said input display data for each pixel electrode, wherein, during a period of time corresponding to each first frame, said applying comprises applying a first voltage between each appropriate one of said plurality of the pixel electrodes and said transparent counter electrode to move said first colored charged particles toward a side of said display surface and to move said second colored charged particles away from said side of said display surface, wherein, during a period of time corresponding to each second frame, said applying comprises applying a second voltage between each appropriate one of said plurality of the pixel electrodes and said transparent counter electrode to move said second colored charged particles toward a side of said display surface and to move said first colored charged particles away from said side of said display surface, and providing said first and/or second frames, respectively, during a period of a first transition state changing from a current picture whose display state is brought by said first colored charged particles to a next picture whose display state is brought by said second colored charged particles, and during a period of a second transition state changing from a current picture whose display state is brought by said second colored charged particles to a next picture whose display state is brought by said first colored charged particles, for each appropriate pixel electrode, on condition of satisfying a following equation:

$$Twb(+)+Tbw(+)=Tbw(-)+Twb(-),$$

where Twb(−) denotes a number of said first frames which are provided during the period of the first transition state, and Twb(+) denotes a number of said second frames which are provided during the period of the first transition state, Twb(−) being not equal to Twb(+); and Tbw(−) denotes a number of said first frames which are provided during the period of the second transition state, and Tbw(+) denotes a number of said second frames which are provided during the period of the second transition state, Tbw(−) being not equal to Tbw(+).

6. The method of driving the electrophoretic display device according to claim 5, further comprising:

providing said first and second frames, respectively, during a period of a third transition state changing from a current picture whose display state is brought by said first colored charged particles to a next picture whose display state is brought by said first colored charged particles, and during a period of a fourth transition state changing from a current picture whose display state is brought by said second colored charged particles to a next picture whose display state is brought by said second colored charged particles, for each appropriate pixel electrode, on condition of satisfying a following equation:

$$Tww(+)=Tww(-), \text{ and}$$

$$Tbb(+)=Tbb(-),$$

where Tww(−) denotes a number of said first frames which are provided during the period of the third transition state, and Tww(+) denotes a number of said second frames which are provided during the period of the third transition state, and Tbb(+) denotes a number of said second frames which are provided during the period of the fourth transition state, and Tbb(−) denotes a number of said first frames which are provided during the period of the fourth transition state.

7. The method of driving the electrophoretic display device according to claim 4, wherein said Tww(+) is set to be not equal to said Tbb(+).

8. A method of driving an electrophoretic display device which includes a pixel substrate including a plurality of signal lines, a plurality of scanning lines, said signal lines and scanning lines intersecting each other, and a plurality of pixel electrodes as electrophoretic elements disposed at intersections of said signal lines and said scanning lines, a facing substrate including a transparent counter electrode to face said plurality of pixel electrodes and making up a display surface, and an electrophoretic film sandwiched between said pixel substrate and said facing substrate and including first colored charged particles with a first color and a first polarity and second colored charged particles with a second color and a second polarity, said second color and said second polarity being different from said first color and said first polarity, the method comprising:

selecting a time-series voltage in response to input display data for each pixel electrode, and applying the selected time-series voltage between said each pixel electrode and said transparent counter electrode, during a period of time corresponding to a specified number of frames comprising at least first or second frames or halftone frames which are selectively provided based on said input display data for each pixel electrode, wherein, during a period of time corresponding to each first or second frame, said applying comprises applying a first or second voltage between each appropriate one of said plurality of the pixel electrodes and said transparent counter electrode to move said first or second colored charged particles toward a side of said display surface and to move said second or first colored charged particles away from said side of said display surface, wherein, during a period of time corresponding to each halftone frame, said applying comprises applying an intermediate voltage between each appropriate one of said plurality of the pixel electrodes and said transparent counter electrode, said intermediate voltage set between said first voltage and second voltage, and providing said first or second frames and/or halftone frames, respectively, during a period of first transition state changing from a current picture whose display state is brought by said first or second colored charged particles to a next picture whose display state is a halftone, and during a period of a second transition state changing from a current picture whose display state is a halftone to a next picture whose display state is brought by said first or second colored charged particles, for each appropriate pixel electrode, on condition of satisfying a following equation:

$$Twg(+)+Tgw(+)=Twg(-)+Tgw(-),$$

where Twg(−) denotes a number of said first or second frames which are provided during the period of the first transition state, and Twg(+) denotes a number of said halftone frames which are provided during the period of the first transition state, Twg(−) being not equal to Twg (+); and Tgw(−) denotes a number of said first or second frames which are provided during the period of the second transition state, and Tgw(+) denotes a number of said halftone frames which are provided during the period of the second transition state, Tgw(−) being not equal to Tgw(+).

* * * * *